US010920343B2

(12) United States Patent
Tolle

(10) Patent No.: US 10,920,343 B2
(45) Date of Patent: Feb. 16, 2021

(54) FIXED ORIENTATION WEAVING APPARATUS

(71) Applicant: James Tolle, Manassas, VA (US)

(72) Inventor: James Tolle, Manassas, VA (US)

( * ) Notice: Subject to any disclaimer, the term of this patent is extended or adjusted under 35 U.S.C. 154(b) by 113 days.

(21) Appl. No.: 16/411,132

(22) Filed: May 13, 2019

(65) Prior Publication Data

US 2019/0352813 A1 Nov. 21, 2019

Related U.S. Application Data

(60) Provisional application No. 62/673,099, filed on May 17, 2018.

(51) Int. Cl.

| | |
|---|---|
| ***D03D 29/00*** | (2006.01) |
| ***D03D 1/00*** | (2006.01) |
| ***D03D 49/24*** | (2006.01) |
| ***D03D 47/34*** | (2006.01) |
| ***D03D 47/12*** | (2006.01) |
| ***D03J 1/00*** | (2006.01) |
| ***D03D 47/27*** | (2006.01) |
| ***D01F 1/09*** | (2006.01) |

(Continued)

(52) U.S. Cl.

CPC ..... *D03D 49/24* (2013.01); *D01F 1/09* (2013.01); *D03D 1/0088* (2013.01); *D03D 47/125* (2013.01); *D03D 47/271* (2013.01); *D03D 47/34* (2013.01); *D03J 1/007* (2013.01); *H01B 5/14* (2013.01); *H01B 13/0026* (2013.01); *D03D 2700/149* (2013.01); *D03J 2700/06* (2013.01)

(58) Field of Classification Search

CPC ..... D03D 49/24; D03D 1/0088; D03D 47/34; D03D 47/125; D03D 47/271; D03D 2700/149; D03D 47/14; D03D 47/25; D03D 47/18; D03D 47/23; D03D 15/0061; D03D 2700/1468; D03D 47/00; D03D 47/24; D03D 47/272; D03D 2700/1409; D03D 2700/145; D01F 1/09; D01F 6/18; D01F 6/62; H01B 5/14; H01B 13/0026; D03J 1/007; D03J 5/06; D03J 2700/06; D06M 11/83; D06M 2101/32; D06M 2101/28; D01D 5/0007; D10B 2401/16

See application file for complete search history.

(56) References Cited

U.S. PATENT DOCUMENTS

| | | | |
|---|---|---|---|
| 2,134,125 | A | 10/1938 | Hoff |
| 3,266,528 | A | 8/1966 | Liebchen |

(Continued)

*Primary Examiner* — Robert H Muromoto, Jr.

(57) ABSTRACT

A shuttleless weaving loom with a weft insertion device. A transfer device and retaining disc are connected to the weft insertion device such that the retaining disc holds the weft fiber in a fixed orientation as it traverses through the shed of the loom. A plurality of sensors which are part of a micro-circuit are mounted on the retaining disc for measurement of the weft fiber's position. A signaling circuit is mounted on the shuttleless loom and an electrical connector is connected to the signaling circuit to allow for external monitoring or display of the weft fiber's position. The measurements from the plurality of sensors are communicated through the electrical connector to an external device such that the position and orientation of the weft fiber can be monitored or displayed as the weft insertion device travels through the shuttleless loom.

28 Claims, 27 Drawing Sheets

(51) Int. Cl.
*H01B 5/14* (2006.01)
*H01B 13/00* (2006.01)

(56) References Cited

U.S. PATENT DOCUMENTS 3,851,679 A * 12/1974 Titov ..... D03D 47/26 139/194
4,041,991 A * 8/1977 Dewas ..... D03D 47/271 139/449
4,194,538 A * 3/1980 Borodin ..... D03D 47/26 139/194
4,223,703 A * 9/1980 Pfarrwaller ..... D03D 47/24 139/145
4,427,037 A 1/1984 Hill
4,508,146 A * 4/1985 Hintsch ..... D03J 5/06 139/196.2
4,640,316 A 2/1987 Wakai
4,915,143 A * 4/1990 Grossmann ..... D03D 47/125 139/438
5,018,557 A * 5/1991 Fourneaux ..... D03D 47/34 139/450
5,090,456 A 2/1992 Kasahara
5,351,724 A * 10/1994 Zenoni ..... B65H 51/16 139/452
5,806,744 A * 9/1998 Paoletti ..... B65H 59/18 226/155
7,124,783 B2 10/2006 Powell
7,810,526 B2 10/2010 Yamashita
2018/0179675 A1 6/2018 Rutz

* cited by examiner

FIXED ORIENTATION WEAVING APPARATUS

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The following notice applies to all documentation described below and to all drawings accompanying and made part of this document: © 2018-2019 James Tolle.

CROSS-REFERENCES TO RELATED APPLICATIONS

This application claims the benefit of priority of the provisional patent application No. 62/673,099, "Nanoconductor smart wearable technology and electronics".

BACKGROUND OF THE INVENTION

Field of the Invention

The field of the invention is loom apparatus for weaving yarns or threads in a fixed orientation, including rapier, projectile and air jet looms.

The purpose of this invention is to introduce a novel weaving apparatus that supports weaving of threads in fixed orientations. This invention is particularly suited for weaving of nanoconductor fibers with a fixed geometry and orientation within the fell and cloth of the fabric. The wearable nanoconductor technology which is described in the accompanying patent which claims benefit to the same provisional patent as the current invention herein is an example of a fiber intended for textiles which gains advantages from being woven with a fixed orientation in the fabric. Such nanoconductor fibers can take advantage of a fixed orientation among the weave to mate with other nanoconductor fibers or the novel electrical connectors contained in the provisional patent in order to create wearable, smart electronic circuits. The current invention intends to claim the novel loom and weaving apparatus which are also disclosed in the provisional patent for use with such nanoconductor fibers or other threads or fibers which benefit from being woven into a fabric in a fixed orientation.

A "thread" usually refers to a textile yarn which is composed of multiple "fibers". The use of "thread-sized" means a size on the order of the cross-section of a typical single mono-filament fiber, much larger than the nanoscale geometry, with "thread-sized" used herein to depict a fiber or yarn size of 150 microns or larger. The terms "yarn", "thread" and "fiber" may be used interchangeably in the disclosure of the invention. Unless explicitly stated otherwise, the use of one of these terms is not intended to exclude an embodiment which comprises one of the other terms and all such embodiments which are obvious to a person skilled in the art are intended to be within the scope of the invention and covered by its claims. When a "fiber" of fixed orientation is referenced, it should also be interpreted as covering any yarn, thread or fiber known to a person skilled in the art which can have a fixed orientation of any sort and, unless explicitly stated otherwise, includes multi-filament or mono-filament fiber.

Description of Related Art

Rapier looms typically involve the insertion of at least one arm (single rapier), the "giver arm", through the shed of the warp yarn in order to pull a weft yarn to create the weave. The shed is formed out of warp yarn hung through "heddles" in alternating positions, forming an opening between all of the warp yarns through which the weft fiber can be drawn by the rapier arms. These looms can also be referred to as "reciprocating", "tape", "ribbon" or "shuttleless" looms in the prior art. "Shuttleless" is used herein to mean that the weaving apparatus does not comprise any shuttle device which is to be moved through the shed by hand. A dual rapier loom apparatus includes one rapier arm for insertion and a second rapier arm which moves through the shed of the loom from the opposite side of the loom, the "taker arm", in order to meet the giver arm in the middle of the shed and to pull the weft yarn back to the opposite side of the giver arm. A projectile loom is similar to a single arm rapier in that the projectile carries the weft yarn through the shed from one side of the loom to the opposite side. However, in the case of a projectile loom, the projectile which carries the weft yarn is not connected to an arm, but travels across the loom through some means of propulsion, which may be due to force from the motion of a pick lever or, for other types of looms which are similar to projectile looms such as air-jet or multi-phase looms, the carrier of the weft yarn is propelled by other means. The following discussion of the prior art explains how these approaches do not adequately cover all the novel aspects of the current invention nor disclose an obvious means of addressing the making or usage of the current invention by someone skilled in the art.

Early looms are disclosed in U.S. Pat. No. 2,134,125, Hoff, U.S. Pat. No. 3,266,528, Liebchen, et al., and U.S. Pat. No. 4,427,037, Hill, which describe looms which transfer the weft yarn through the shed by means similar to rapier arms, including tapes, reciprocating bars or shuttleless loom with reciprocating rods, respectfully. These and similar prior art are similar to the rapier arm embodiment of the current invention, but they all fail to include the novel aspects of the current invention including the transfer device which both holds the weft yarn or fiber in a fixed orientation and transfers it across the width of the loom in that orientation and also fail to include any kind of electronic sensors borne with the rapier arm to monitor the position of the fiber with fixed orientation.

U.S. Pat. No. 7,810,526, Yamashita discloses a rapier loom apparatus which covers the design of an insert, or giver, rapier for use in a dual rapier loom. Although this prior art includes a rapier arm with moving parts with respect to the weft yarn carried by the rapier arm, this prior art does not teach or claim the novel transfer device or other moving parts of the current invention which support the transfer of the fixed weft yarn from the giver to the taker rapier arm or any other moving parts disclosed with the current invention associated with the transfer and return of the transfer device.

U.S. Pat. No. 7,124,783, Powell, et al., claims a yarn transfer system as part of a loom apparatus, which includes a piezo-electric trigger. The transfer system of Powell is based on parts that are fixed with the giver or taker arm for transfer of the yarn from one to another in a way which is more advantageous to highly accelerated rapier arms. But the parts on each arm in Powell's art do not actually transfer from one arm to another as in the transfer device of the dual rapier arm embodiment of the current invention. Powell also discloses a piezo-electric trigger, electronic circuit and photosensitive element as part of the transfer system. The nature and purpose of the electronic components of Powell's invention is markedly different than the electronic sensors and circuits of the current invention. Powell's electronics provide a trigger for actuation of the parts holding the yarn, which is unrelated to the electronic sensors used to measure position and orientation in the current invention. Furthermore, Powell's electronic circuit is fixed to a part and does not have to provide for continuation of function when a transfer device is passed from one arm to another. These are key differences which distinguish the current invention from the prior art in Powell.

U.S. Pat. No. 5,090,456, Kasahara, describes a rapier loom picking apparatus. It's scope is typical of the prior art which focuses on the insertion point of the loom. Kasahara discloses a picking and gripping apparatus at the side of the loom which feeds the pick of the loom and cuts it with moving parts local to the edge of the weave. It does not teach any part which moves with the arm like the transfer device of the current invention and none of the parts of Kasahara transfer a yarn in a fixed orientation across the shed of the loom. Although Kasahara claims a rack and pinion movement, it is restricted to the picking apparatus on the side of the loom and differs in nature and scope to the movement of parts in the current invention, which are moving relative to the moving rapier arms of the loom. For these reasons, the prior art in Kasahara or other picking inventions like Kasahara's does not relate to the current invention and fails to teach or anticipate any of the novel features of the current invention.

U.S. Pat. No. 4,640,316, Wakai, discloses improvements to an air jet loom which includes a carrier that carries flow velocity detector. Like the current invention, measurement sensors are carried across the width of the loom by a moving transfer apparatus which is instrumented for continuous measurement and which supports an electrical connection to the sensor throughout its motion. However, the purpose and type of sensor used in Wakai is substantially different than the sensor used in the current invention. Wakai's instrumentation is directed toward measuring the air flow in the channel of the air jets. This is markedly different than the instrumentation on the transfer device of the current invention, which uses a novel electronic sensor to measure and report the position or orientation of the weft yarn with respect to the body of the transfer device.

U. S. Patent Application 2018/0179675 A1, Dornier, Ltd, includes various means for measurement of the weft yarns for the purpose of controlling the drawing-off the woven fabric according to the width of the weft yarn. Although this prior art discloses various means of measuring the weft yarn, including optical scanning, acoustic, video image processing and tactile measurements, all such measurement arrangements occur at a fixed point near the insertion of the weft yarn. Dornier does not disclose a measurement device or arrangement which travels with the end of the weft yarn on the transfer device as in the current invention. Dornier's application also does not teach the use of an electronic measurement of the position of the yarn or fiber in the transfer device for the purpose of weaving a fiber with a fixed geometric orientation to the structure of the fabric, which is a novel aspect of the current invention.

As can be seen by the preceding review of the prior art and the background of the current invention, no single example of art achieves all of the novel features of the current invention. Furthermore, no person skilled in the art would see an obvious combination of this art in order to cover what is disclosed in the current invention, there is no teaching, suggestion or motivation in the prior art to combine the references, and a resulting combination would not be understood to produce predictable results by someone with ordinary skill in the art. The current invention is a novel and not obvious invention which comprises the following features which are key for solving the need for smart wearable electronics:

apparatus to insert a fixed thread or yarn through a weave a transfer device which transfers the fixed thread or yarn across the shed an element which holds the weft thread or yarn in a fixed position while it is transferred across the loom electronic sensors which measure the position and orientation of the fixed thread or fiber as it moves through the shed a connection between the electronic sensors and a signaling circuit which allows the measurement signals from the moving transfer device to be continuously reported to an external monitoring system or operator a transfer device which delivers the end of a yarn or thread to the other side from the insertion point an apparatus which returns the transfer device to the insertion point after transfer is completed.

BRIEF SUMMARY OF THE INVENTION

The current invention of this application relates to an apparatus for weaving which transfers a yarn through the weave in a fixed orientation and its preferred embodiment is suited for use with a fiber or yarn as described in the related provisional application in which the orientation of the yarn must be fixed throughout all or part of the woven fabric. The remainder of this application is based on the description from the provisional application which discloses a nanoconductor fiber with a fixed geometry which is integrated with clothing through the use of different loom apparatus that transfer the fiber across the shed in a fixed orientation. The current patent application relates to the apparatus described in the provisional application which supports the integration of the nanoconductor fibers in the cloth. Although the description from the provisional application specifically covers nanoconductor fibers, the intent of the current invention is to include any fibers or threads which need to be transferred across the width of a weaving apparatus in a fixed orientation or position.

The present invention discloses nanoconductor electronics and technology which is more fully integrated with textiles for garments of clothing or other applications. For wearable electronics to be fully integrated with the weave of a cloth or garment, the components have to approach nanoscale geometries. Limitations of previous wearable conductors arise because they are based on metallic threads or textile fibers that are coated or impregnated with conductive material, all of which fail to achieve dimensions smaller than the weave of the textile. In order to achieve a nano-scale conductor which can integrate within the weave of the clothing, typical electrospinning techniques are used to create a metalized nanoconductor matrix to start the fabrication of the invention.

The present invention utilizes the novel geometry of a nano-scale geometry to support textile weaving of the nanoconductor into the weave of the garment or cloth. The disclosure's novel fabrication process allows a nanoconductor structure of any length along the fiber used. This supports the integration of the nanoconductor across the length of a garment or only within a region of the cloth. The intention of this invention is to cover all configuration and sizes of clothing or other fabrics integrated with the technology comprising the invention which are obvious to anyone skilled in the art and such configuration and sizes are within the scope of the invention and are covered by the its claims.

The present invention also discloses novel technology based on the uniform geometry of the nanoconductor structure which allows connection of the conducting surfaces of the textile with electrical contacts and wires to outside circuits. Furthermore, the weaving of the fixed geometry of the nanoconductor structures also support the integration of electronic and semi-conducting components within the circuit of the wearable technology which allow the present invention to disclose applications of the wearable nanoconductor electronics as "smart" circuits or technologies which have features and properties that can be tailored to different user applications. The intention of this invention is to cover any and all types of electronic circuits, applications and technology based on the integration of the invention with an article of clothing which are obvious to a person skilled in the art and all such applications are within the scope of the invention and are covered by its claims.

As a summary of the invention, the invention is weaving apparatus comprising a support frame with a plurality of heddles attached to the support frame, wherein the heddles hold warp threads in an alternating manner to create a shed through which a weft fiber can be inserted. A weft insertion device is connected to the support frame and positioned at the opening of the shed so that it can travel across the shed to the opposite side of the support frame. A weft fiber feeding system is mounted on the support frame next to the opening of the shed so it can feed the weft insertion device. A transfer device Is connected to the weft insertion device and a retaining element which is attached to the transfer device picks a weft fiber from the weft fiber feeding system and holds the weft fiber in a fixed orientation as it travels with the weft insertion device to the opposite side of the apparatus. A fiber removal system is connected to the support frame on the side opposite the weft insertion side, wherein the fiber removal system removes the weft fiber from the retaining ring of the transfer device when the transfer device and weft insertion device reach the side opposite of the insertion point. The weft fiber is placed into the weave of the warp yarns in a fixed orientation after removal from the retaining ring and the transfer device and weft insertion device return to the insertion point for picking another weft fiber.

An alternative embodiment of the invention is a weaving apparatus comprising a shuttleless loom such as a loom with a single rapier arm, a rapier arm loom with at least two rapier arms, or a projectile loom. A weft insertion device is attached to the shuttleless loom and a weft fiber feeding system is attached to the shuttleless loom, which feeds weft fiber to the weft insertion device. A transfer device is connected to the weft insertion device which traverses the shed of the shuttleless loom and a retaining disc is attached to the transfer device, wherein the retaining disc holds a weft fiber in a fixed orientation as it travels through the shed. The transfer device and retaining disc draw the weft fiber through the shed of the shuttleless loom to the other side of the shuttleless loom, release the fiber and return to the weft insertion device's original position.

Yet another embodiment of the current invention is a weaving apparatus comprising a shuttleless loom such as a loom with a single rapier arm, a rapier loom with at least two rapier arms, or a projectile loom. A weft insertion device is attached to the shuttleless loom and a weft fiber feeding system is attached to the shuttleless loom, which feeds weft fiber to the weft insertion device. A transfer device is connected to the weft insertion device which traverses the shed of the shuttleless loom and a retaining disc which is attached to the transfer device holds a weft fiber in a fixed orientation as it travels through the shed. A microcircuit is integrated with the retaining disc, transfer device, and weft insertion device. A plurality of sensors which are part of said microcircuit are mounted on the retaining disc for measurement of the weft fiber's position. A signaling circuit is mounted on the shuttleless loom for transmitting the measurement signals to external monitoring or display equipment and an electrical connector is mounted on the shuttleless loom and connected to the signaling circuit to allow for external monitoring or display of the weft fiber's position. The measurements from the plurality of sensors are communicated through the microcircuit, the signaling circuit and the electrical connector to an external device such that the position and orientation of the weft fiber can be monitored or displayed as the weft insertion device travels through the shuttleless loom. During the monitoring, the transfer device and retaining ring draw the weft fiber through the shed to the other side, release the fiber and return to the weft insertion device's original position.

Another embodiment which summarizes the current invention is a loom based on dual rapier arms comprising a giver arm attached to the loom on the side where weft fiber is fed to the loom, a taker arm attached to the loom on the side opposite of the weft fiber feeding system, and a transfer device connected to the giver arm device which traverses the shed of the loom. A weft fiber feeding system is attached to the loom which feeds weft fiber to the transfer device on the giver arm. A retaining disc is attached to the transfer device and when the transfer device is fitted to the giver arm in its default position at the weft fiber feeding side of the loom, a weft fiber is fed into the retaining disc. The retaining disc holds a weft fiber in a fixed orientation as it travels through the shed. One set of projecting pins, the taker projecting pins, is attached to the taker arm side of the transfer device and one or more capture arms are attached to the taker arm. The capture arms capture the taker projecting pins when the giver arm meets the taker arm in the middle of the shed of the loom and the transfer device slides longitudinally along the frame of the giver arm such that it travels with the taker arm after capture, drawing the retainer disc and weft fiber through the width of the loom's shed. A spring loaded deflection plate is attached to the giver arm and one or more return arms are connected to the deflection plate, which are operationally associated with the deflection plate such that when the deflection plate is down with the spring compressed, the return arms are down. When the spring forces the deflection plate up, the return arms are raised into their return position. The default position of the return arms and deflection plate is the down position when the transfer device is on the giver arm at the side of insertion. The return arms and deflection plate move to the up position when the transfer device moves from the giver arm to the taker arm after the rapier arms meet in the middle of the loom's shed. A pinion is connected to the hub of at least one of the return arms and a rack engages the pinion. The operation of the pinion on the rack translates the rotation of the return arms to a linear movement of the rack such that the rack moves along the longitudinal direction of giver arm. An actuator shaft connected to the rack which moves linearly along the longitudinal direction of the giver arm such that the actuator shaft extends beyond the end of the giver arm when the return arms move to the up position. An actuator lever is attached to the taker arm such that the extended actuator shaft of the giver arm can move the actuator lever when the giver arm and taker arm meet. The actuator lever is operationally associated with the capture arms of the taker arm such that when the actuator lever is moved by the extended actuator shaft of the giver arm, the capture arms move and release the taker projecting pins on the transfer device. A set of projecting pins, the receiver projecting pins, is connected to the giver side of the transfer device such that when the giver arm and taker arm meet, the return arms are in a position to capture the receiver projecting pins and return the transfer device to the giver arm.

The preferred embodiment of the current invention discloses an apparatus which weaves a weft fiber of a fixed orientation into a cloth. However, any other embodiment based on a combination of weft and warp fibers of fixed orientation which is obvious to a person skilled in the art is intended to be within the scope of the current invention and covered by its claims. Furthermore, the preferred embodiment discloses a retaining disc which is disc-shaped and holds a fiber in a slot. A retaining disc or element of any other shape or design which would hold a fiber or thread in a fixed orientation as it is pulled by the transfer device which is obvious to a person skilled in the art is intended to be within the scope of the current invention and covered by its claims.

BRIEF DESCRIPTION OF THE SEVERAL VIEWS OF THE DRAWING

The description of the current invention relies on the following drawings. These drawings are not to scale, contain only enough detail for descriptive purposes, and are intended to aid in understanding of the invention and the concepts and methods of how it is made and how it is used with the accompanying specification.

FIG. 7B shows the back view of the transfer device which conveys the nanoconductor fibers through the loom.

Figure 7A:
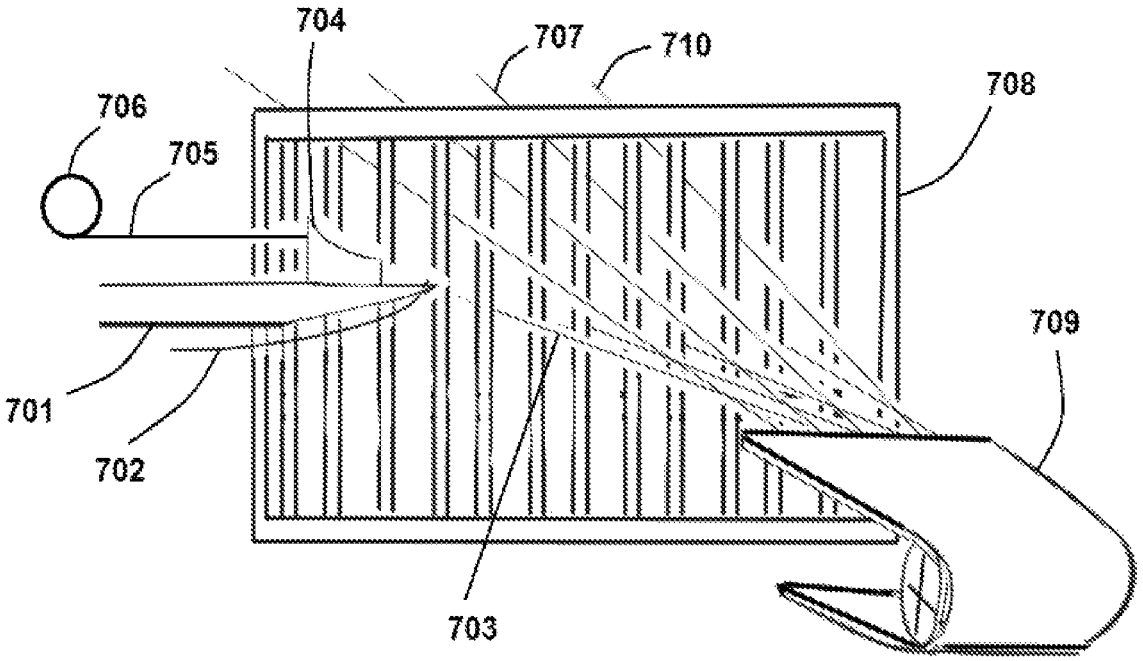
FIG. 7A through FIG. 7L are diagrams showing modified apparatus for weaving of the nanoconductor fibers in a fixed orientation within a textile, which can be described as follows. An example of a rapier loom concept which enables the invention is shown in FIG. 7A.
Figure 7B:
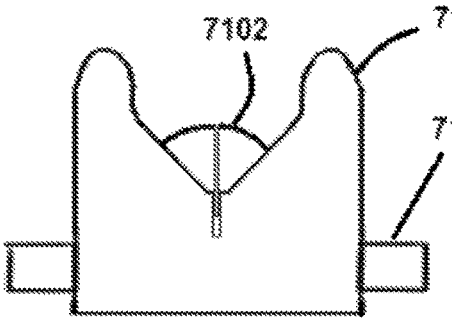
Figure 7C:
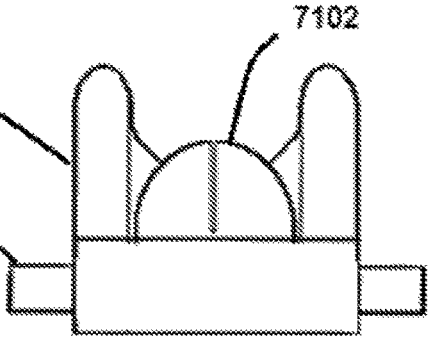

The front view of the transfer device is shown in FIG. 7C.

Figure 7D:
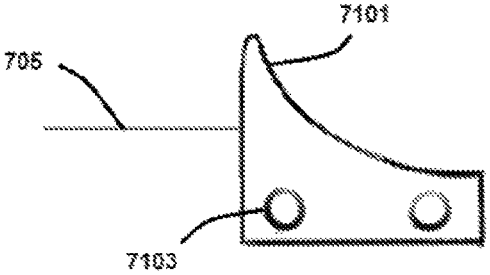

A side view of the transfer device is presented in FIG. 7D.

Figure 7E:
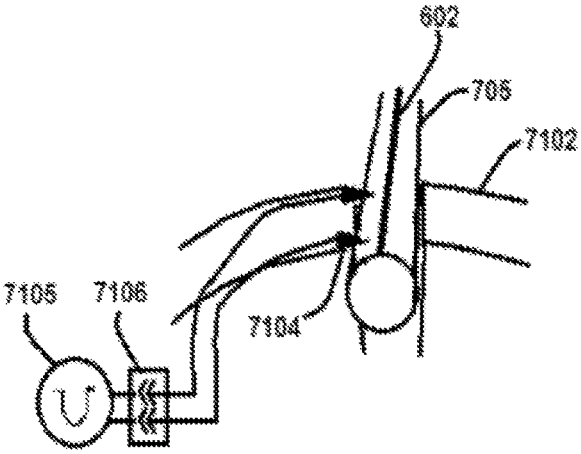

FIG. 7E provides a close-up view of the sensors and retaining disc which is carried by the transfer device.

Figure 7F:
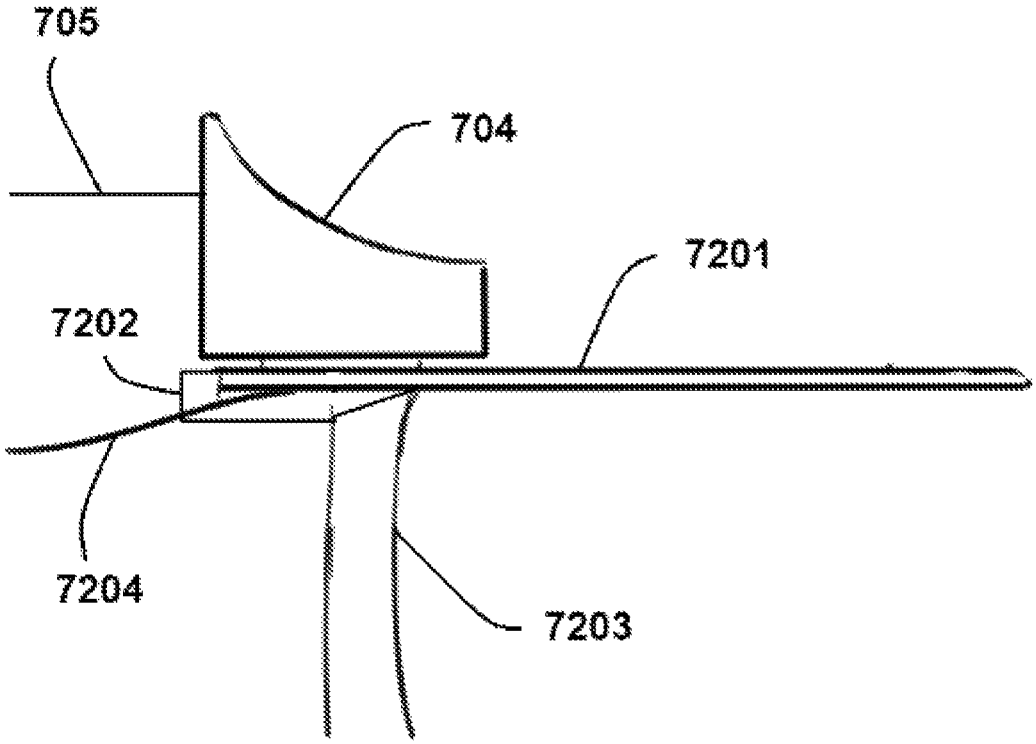

Alternative embodiments of the loom apparatus enabling the invention are given in FIG. 7F to FIG. 7L. FIG. 7F is an example of the transfer device as part of a projectile loom.

Figure 7G:
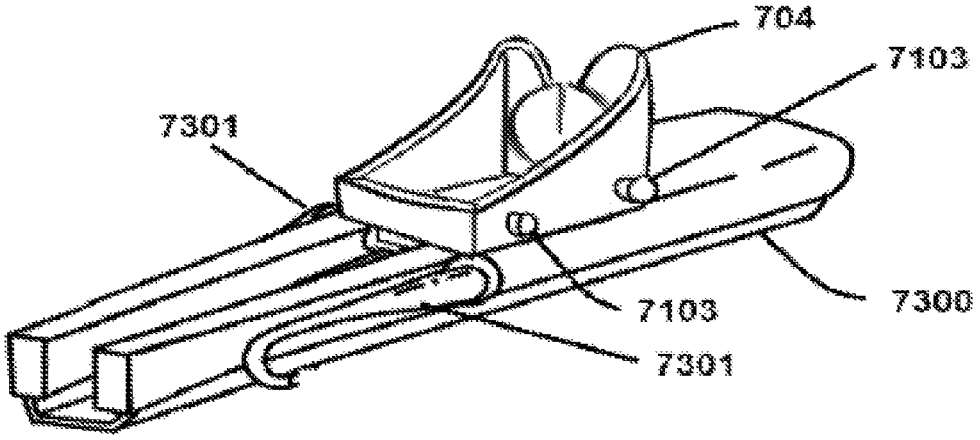

FIG. 7G shows one arm, the giver arm, of a dual rapier loom.

Figure 7H:
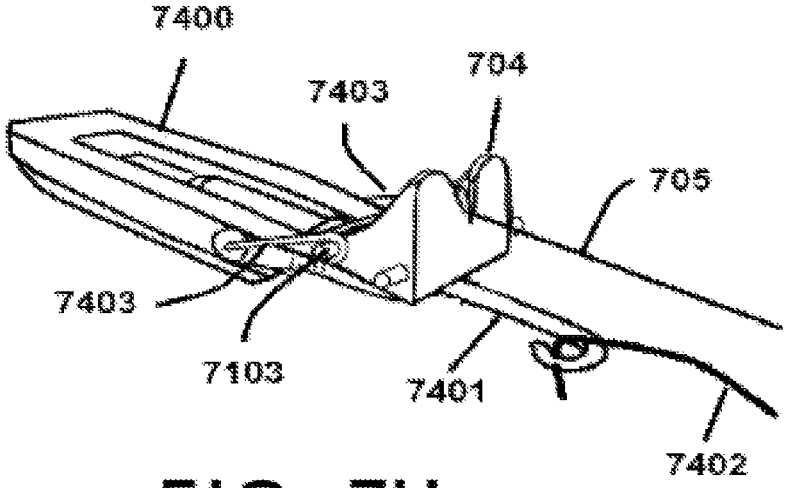

The other arm which receives the transfer device in a dual rapier loom is shown in FIG. 7H, which is the taker arm.

Figure 7I:
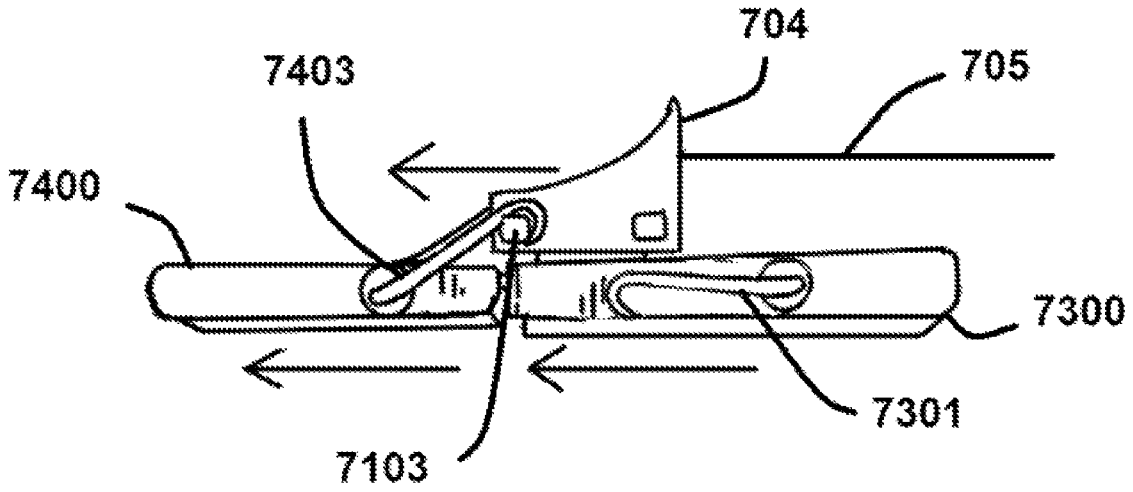

FIG. 7I presents a view of how the transfer device is transferred from the giver arm to the taker arm.

Figure 7J:
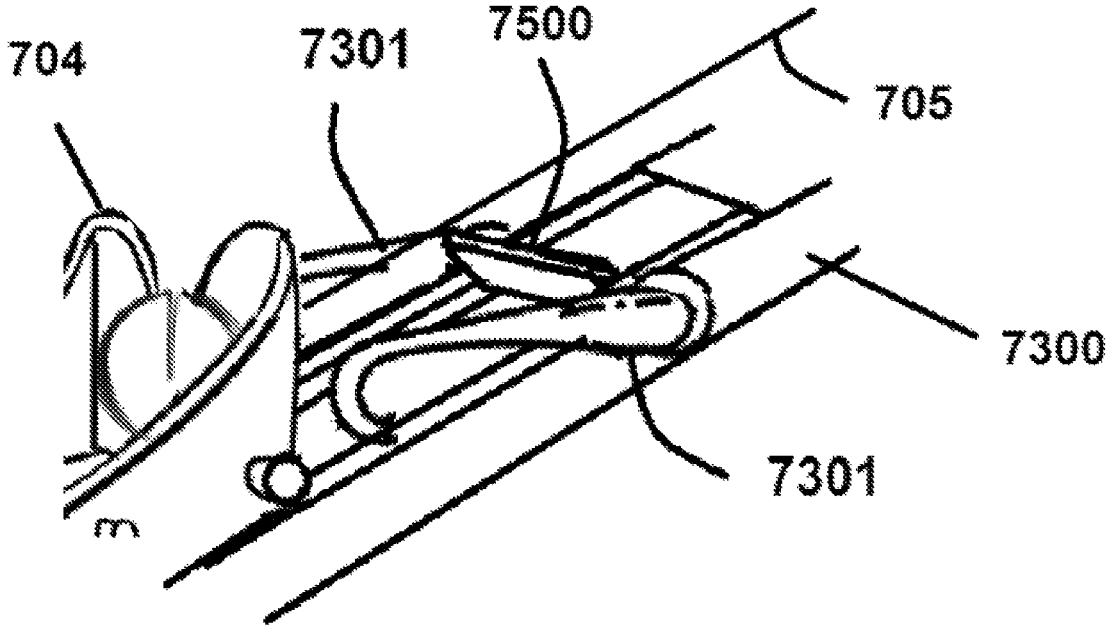

A close-up of the giver arm after the transfer is shown in FIG. 7J.

Figure 7K:
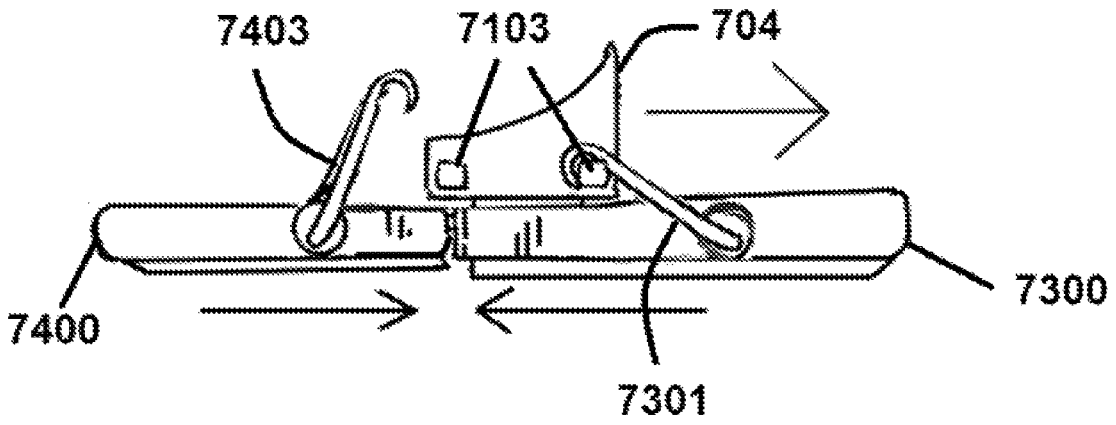

FIG. 7K shows how the transfer device is returned by the taker arm.

Figure 7L:
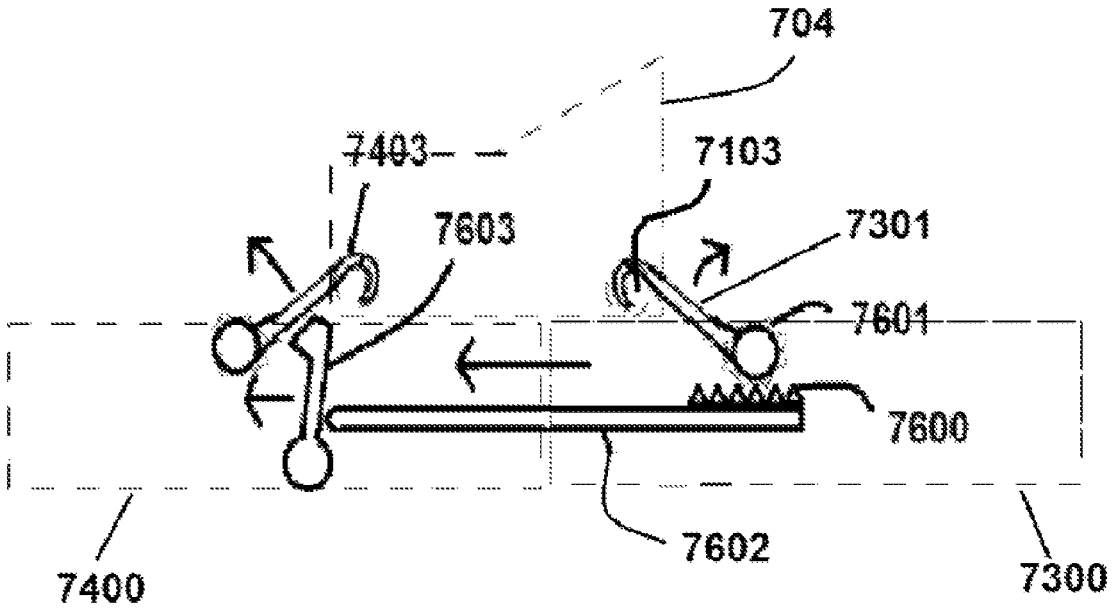

FIG. 7L presents a diagram of how the components of the dual rapier apparatus move during a transfer.

Figure 8:
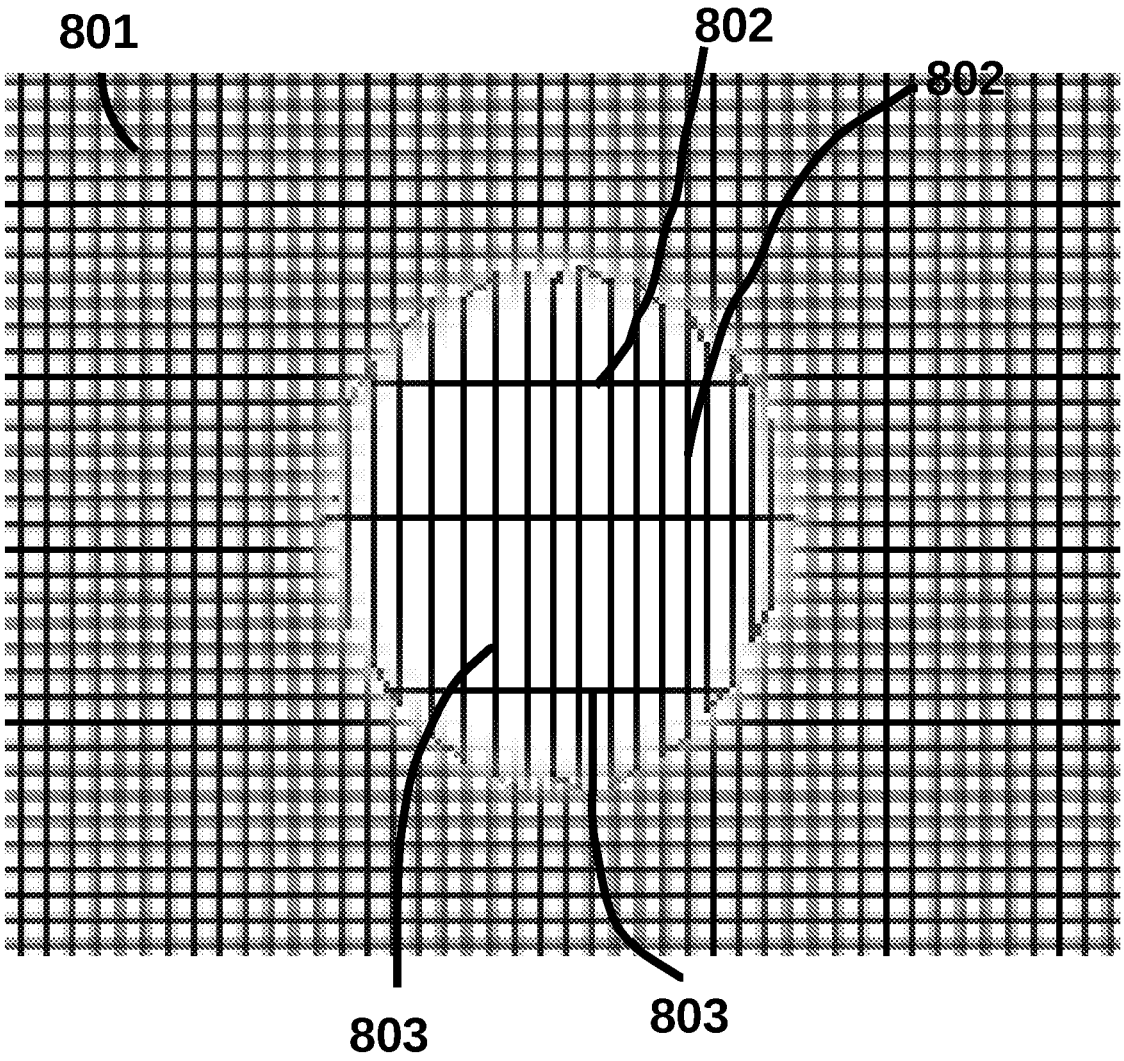

FIG. 8 shows an example of how the invention can be integrated in an area of fabric using darning techniques.

Figure 9:
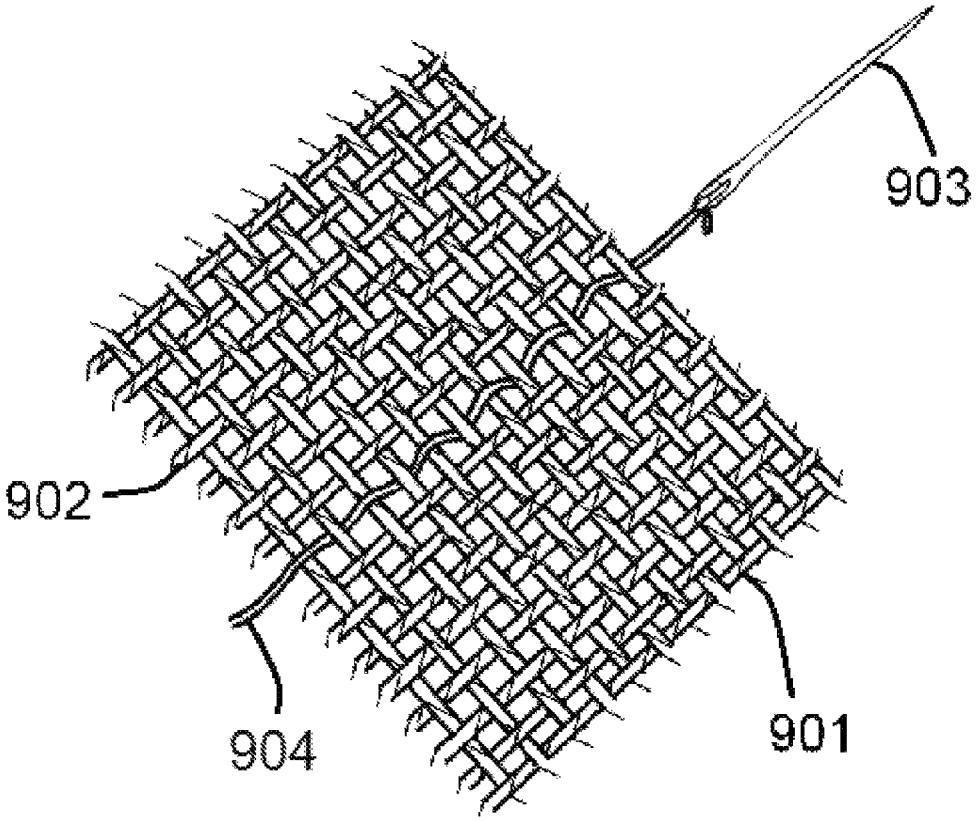

FIG. 9 shows an example of how the invention can be integrated manually in a garment.

Figure 10:
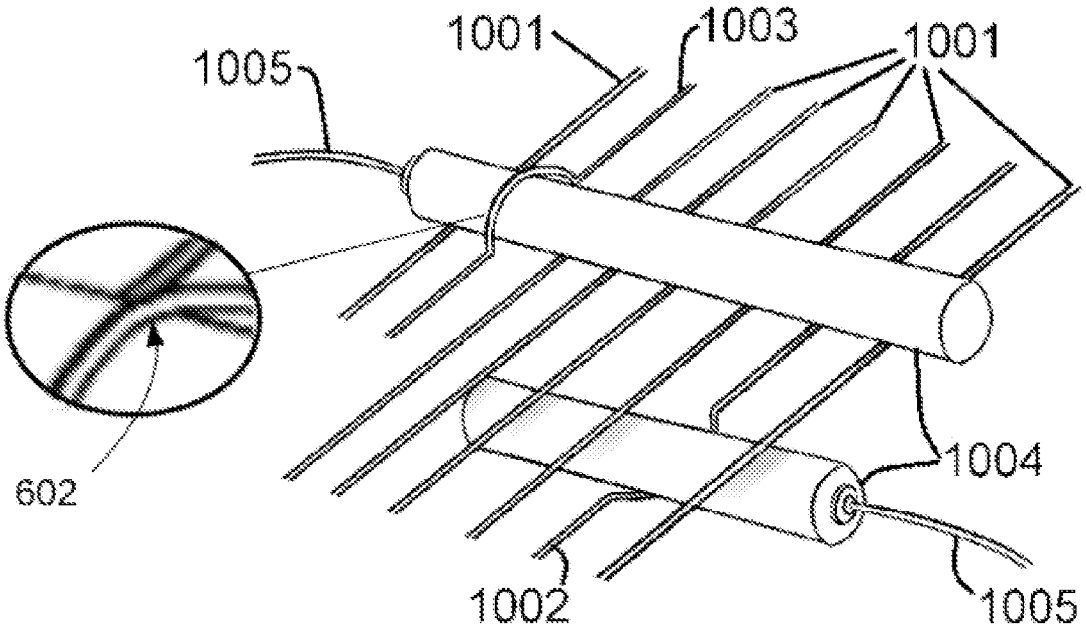

FIG. 10 shows how the unique geometry of the nanoconductor structure integrated in the weave of the cloth supports connection to conducting surfaces and outside electrical circuits.

Figure 11:
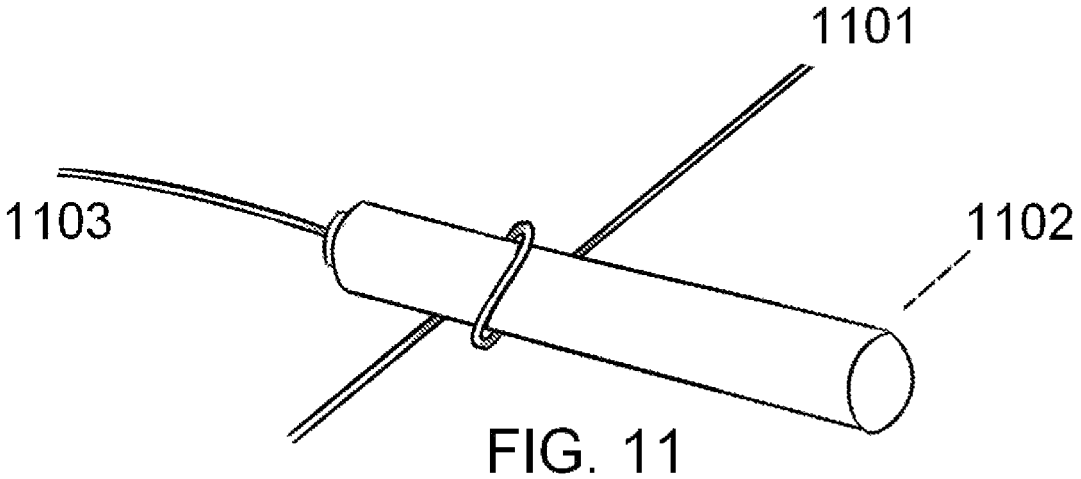

FIG. 11 is an alternative embodiment showing how the nanoconductor structure can alternatively be connected to external conductors, leads or circuits.

Figure 12:
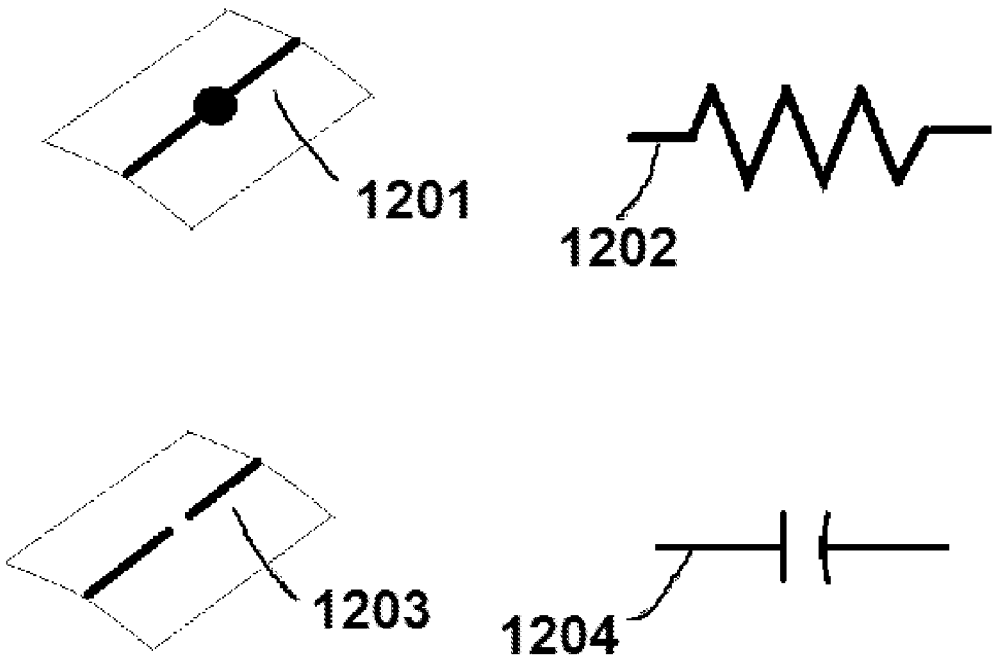

FIG. 12 is diagram showing how the electrical properties of different applications of the nanoconductor geometry can be represented in electrical circuits.

Figure 13:
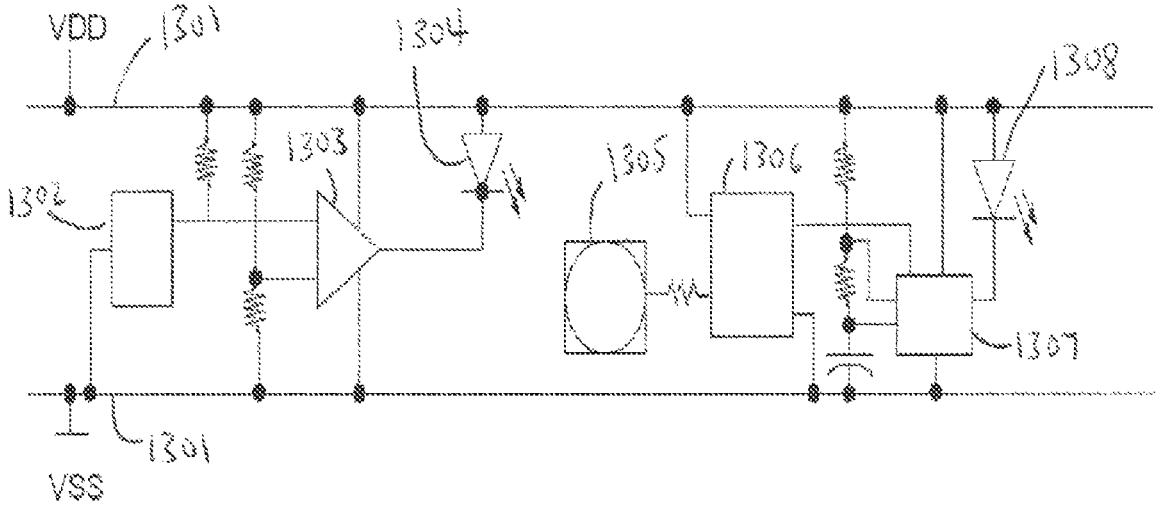

FIG. 13 is a schematic for a simple smart application supported by the invention.

Figure 14A:
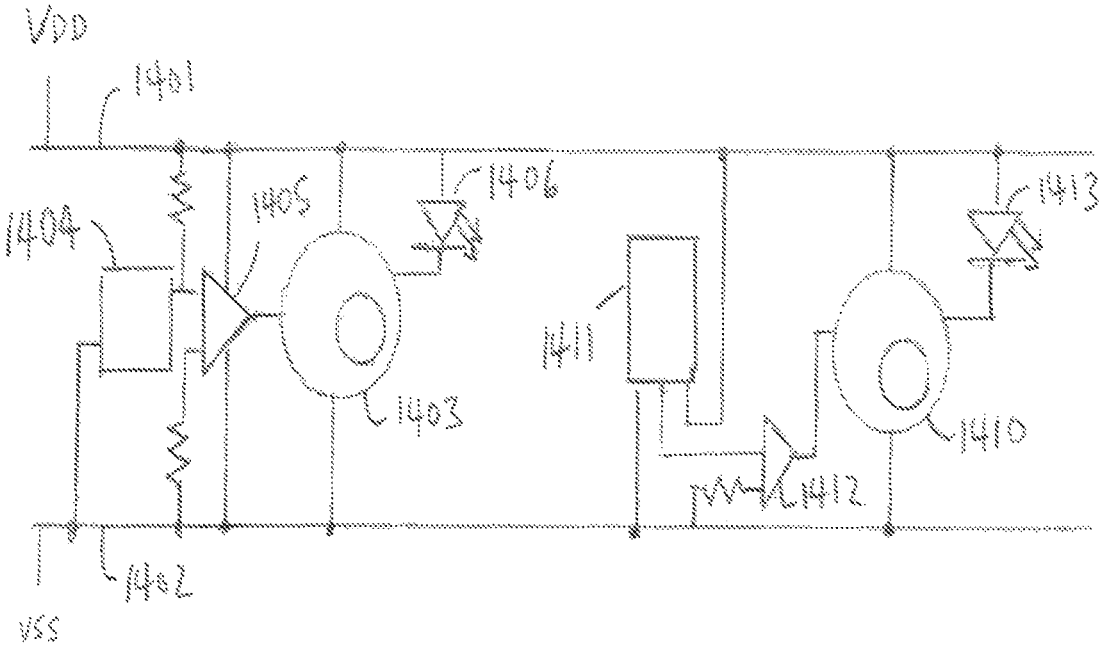

FIG. 14A provides an example of smart application of the invention, showing how components can be grouped within the circuits of the invention.

Figure 14B:
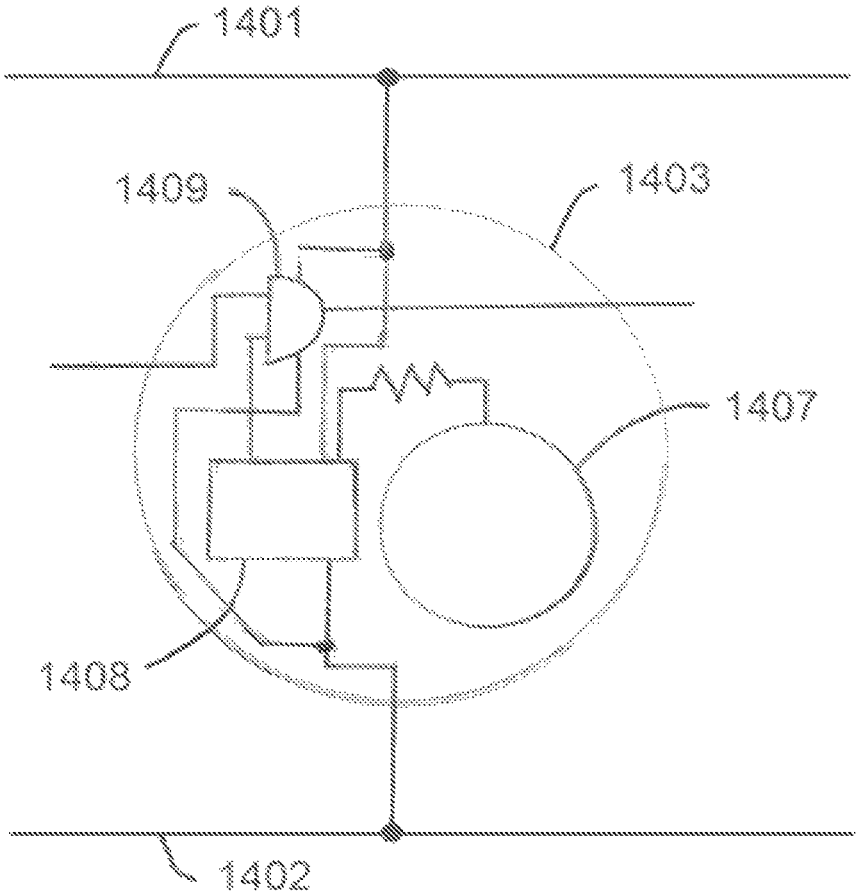

FIG. 14B gives an example of one of the groups which is based on a capsense input component.

Figure 15A:
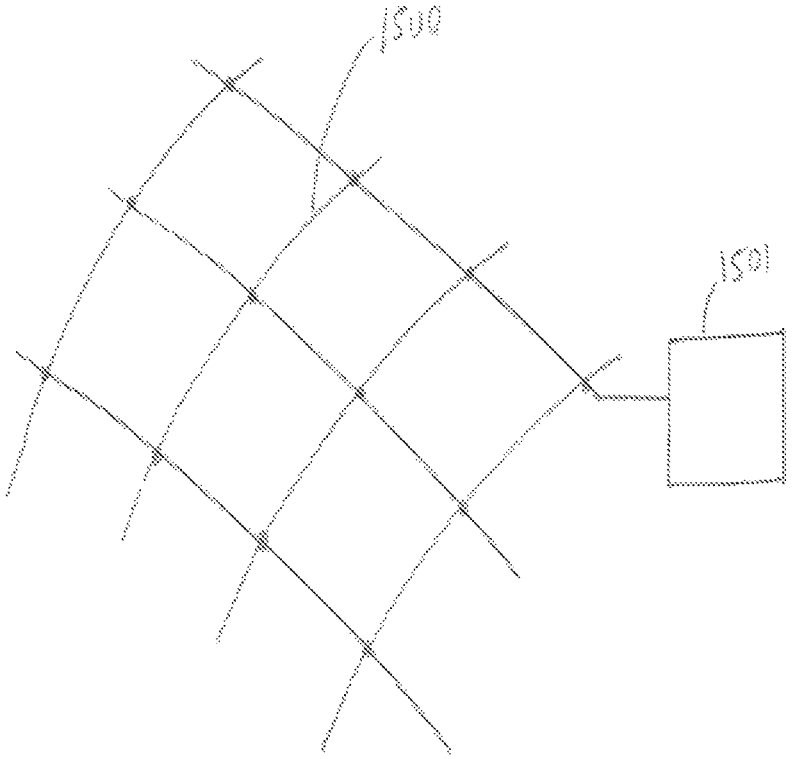

FIG. 15A through FIG. 15 C present the preferred embodiment of the invention as a smart application. FIG. 15A shows a wider view of how the invention can be embodied in a lattice arrangement of programmable nodes to provide a number of smart applications.

Figure 15B:
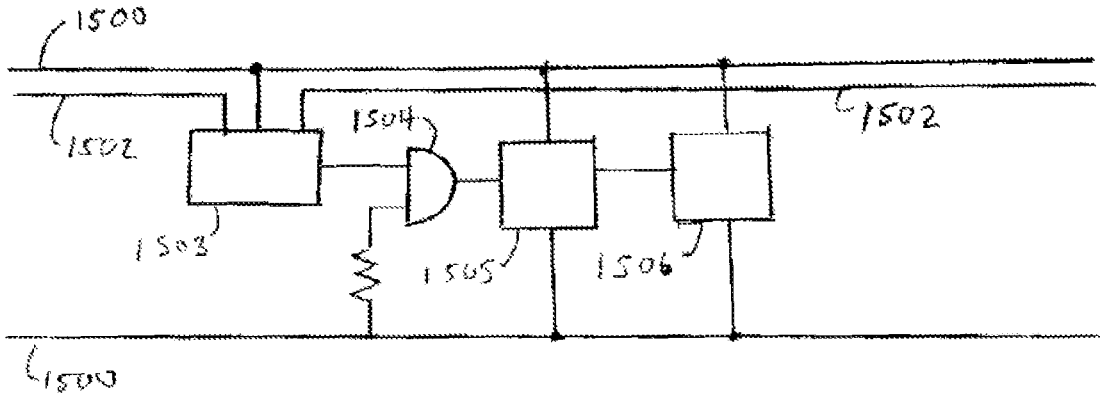

FIG. 15B provides an example of how a node within the lattice of the invention would provide configurable components which can support different smart applications.

Figure 15C:
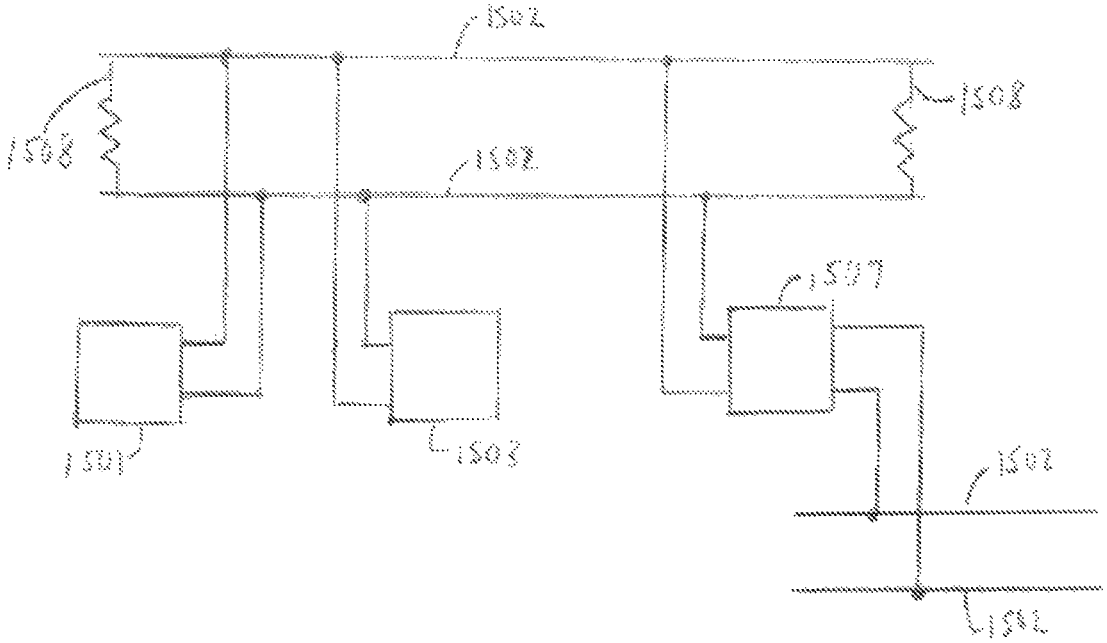

FIG. 15C shows the connection of the nodes to a programmable network which is part of the invention.

Figure 16A:
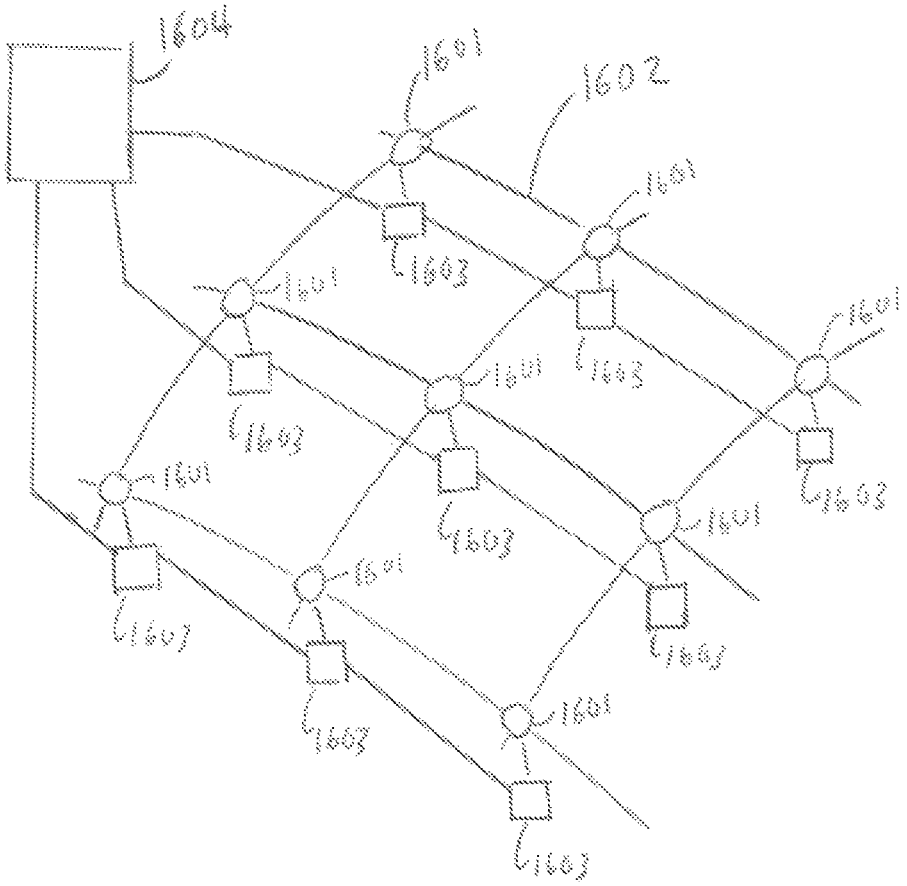

FIG. 16A is a view of the programmable lattice arrangement of the invention which is used as a smart application with re-configurable nodes for use as keypad input devices.

Figure 16B:
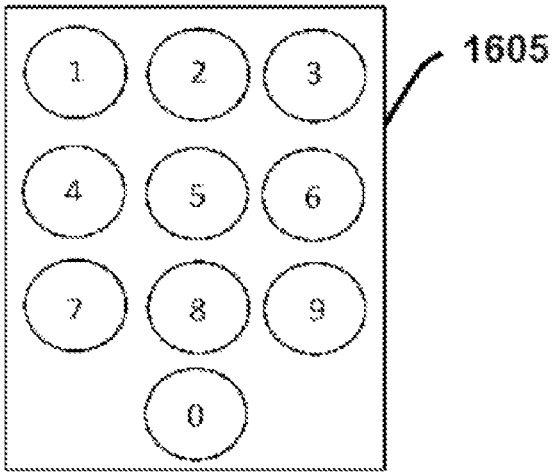

FIG. 16B gives an example of this embodiment used as a keypad.

Figure 16C:
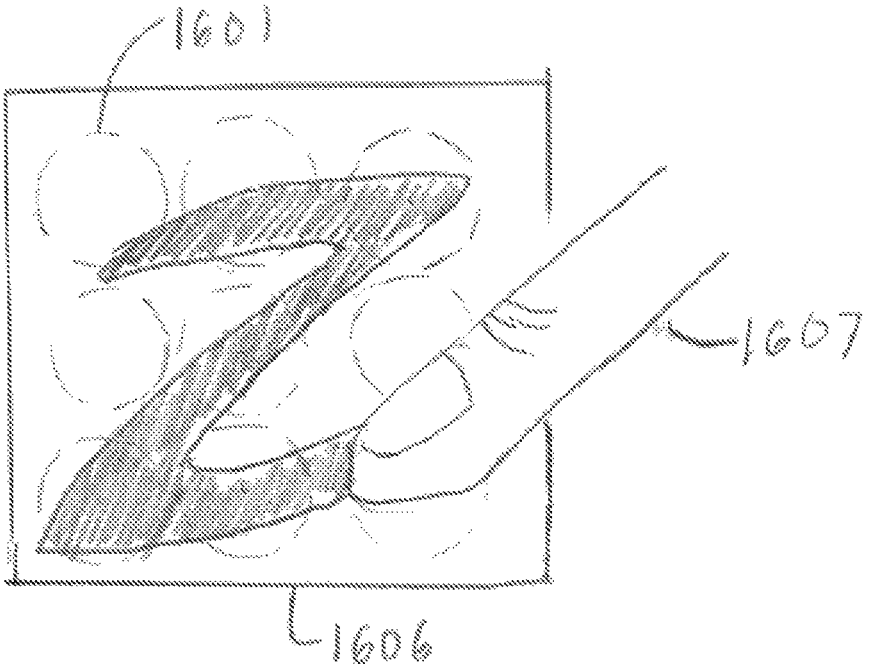

FIG. 16C gives another example of the invention as a touch pad device.

Figure 17A:
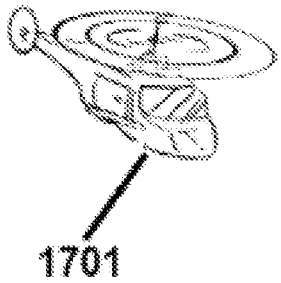
Figure 17A:
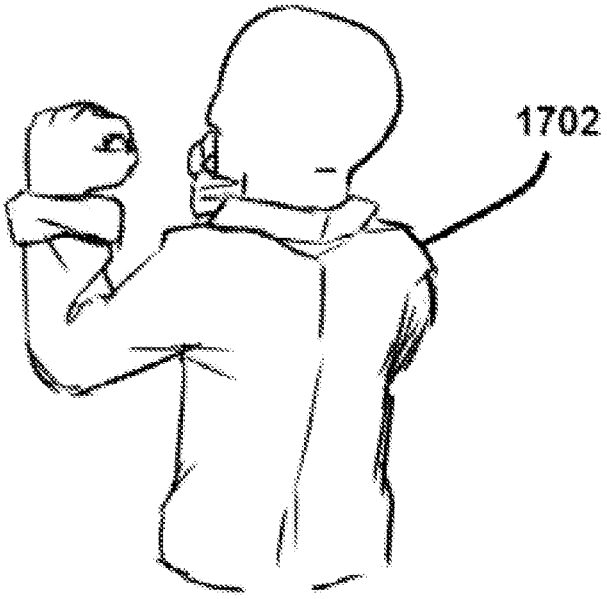

FIG. 17A is an example of how the preferred embodiment can be used as a smart application which is sensitive to a user's arm motions used for ground control of an Unmanned Air Vehicle.

Figure 17B:
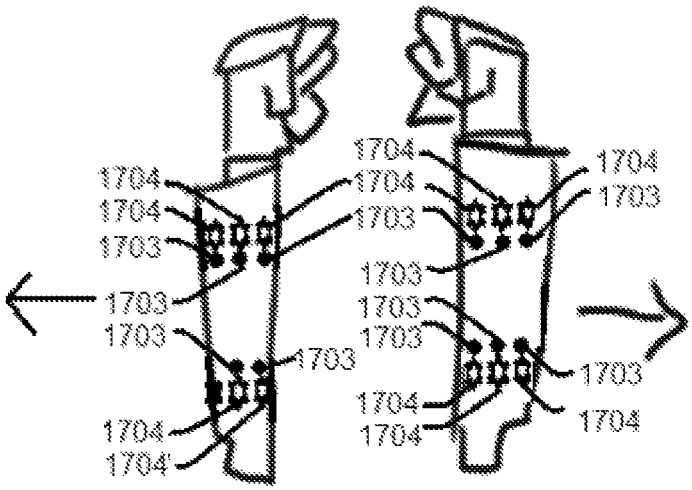

FIG. 17B shows how the invention is used when the user's arms are moved in one direction.

Figure 17C:
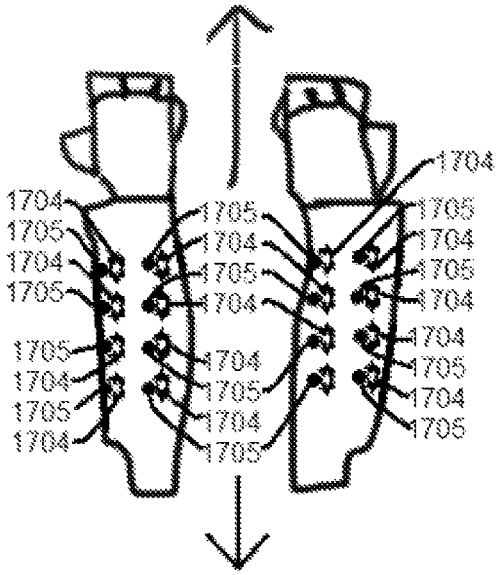

FIG. 17C shows the use of the invention with different arm motion.

DETAILED DESCRIPTION OF THE INVENTION

As used in this specification, the terms "nanoconductor", "nano-scale conductor", "nanoconductor fiber", "nanoscale fiber", "nanoconductor geometry", and "nanoscale geometry" refer to a conducting structure of nanometer scale comprising a combination of metalized, electrospun or similar nanoconductor and a larger textile fiber, such structure running for lengths from centimeters to up to 3 meters of continuous fabric thread.

The term "smart wearable", "smart technology", "smart electronics", "smart circuits" or "smart" refers to electrical circuit or circuits which are integrated with the fabric of the clothing and can be configured to support different circuit paths, electronic applications, or user applications after the technology is woven into the garment. These terms also may be used to refer to the nano-scale integrated components which allow changes to the behavior of the electronic circuits integrated with the clothing.

The following description of the current invention includes the Description of the Preferred Embodiment as well as a description of alternative embodiments and several examples of how the invention can be made and used. Any other use or application of the invention or methods for how it is made which are not specifically contained within this disclosure which are obvious to a person skilled in the art or science are intended to be covered by the current invention.

Figure 1:
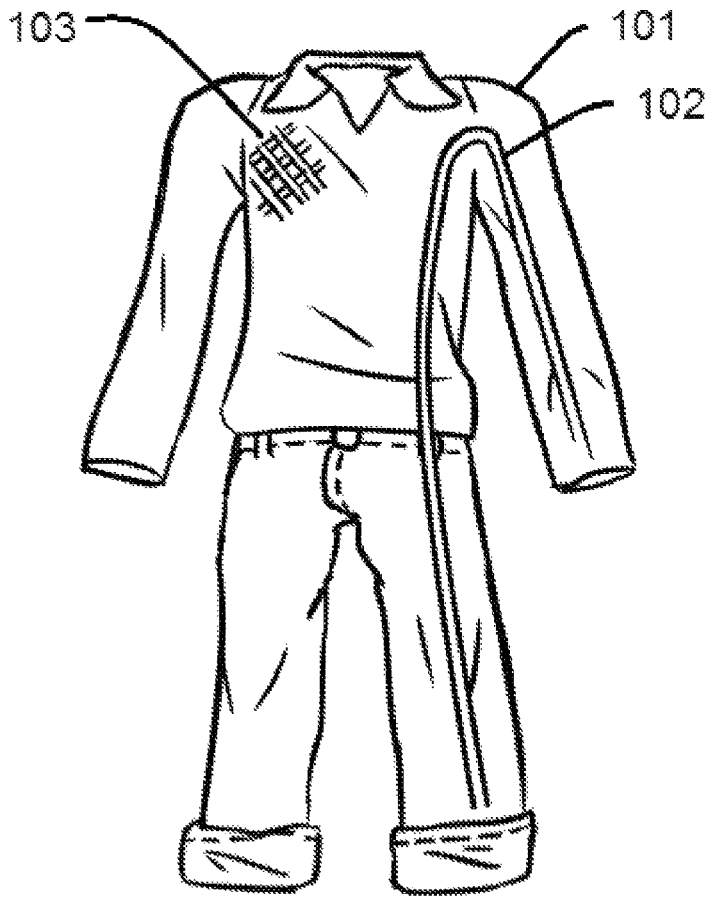
FIG. 1 shows the integration of the invention within a typical article of clothing.

The invention consists of wearable, smart technology which is fully integrated into articles of clothing, an example of which is shown in FIG. 1. 101 is the typical article of clothing used as an example. In this drawing, 101 is shown as an article of clothing which covers most of the body. However, this is just an example and the current invention is intended to be used in any woven cloth article of sizes comprising three fibers thick to articles which would cover multiple users, such as a blanket. Fully integrated into 101 article of clothing is an electronic application 102 comprising one or more nanoconductor structures of sufficient length to run the length of the clothing as shown in FIG. 1. The preferred embodiment is an electronic circuit which integrates the invention's smart application through the length of the garment based on a continuous, fully integrated conductor. An alternative embodiment is one in which the invention's smart application is fully integrated into one article of clothing and optionally connects to the invention's smart application within another article of clothing using the invention's novel connectors, as shown in the example of FIG. 1 for electronic application 102. The electronic application 102 can be specific to the user's requirement, comprising a simple circuit connecting one or more external signaling devices with an external control device or comprising smart technology of the invention along the length of 102, depending on the needs of the user. A separate electronic application 103 of the invention is shown as an example comprising a smaller length of nanoconductor fibers limited to just an area of the article of clothing, depending on the needs of the user.

The foregoing description provided a few examples of how the invention can be fully integrated with an article of clothing. The remainder of the description will disclose the novel design of the invention beginning with how it can be fabricated and continuing with a description of its materials and geometry and how the smart technology comprising the invention supports various novel applications based on its design.

Figure 2:
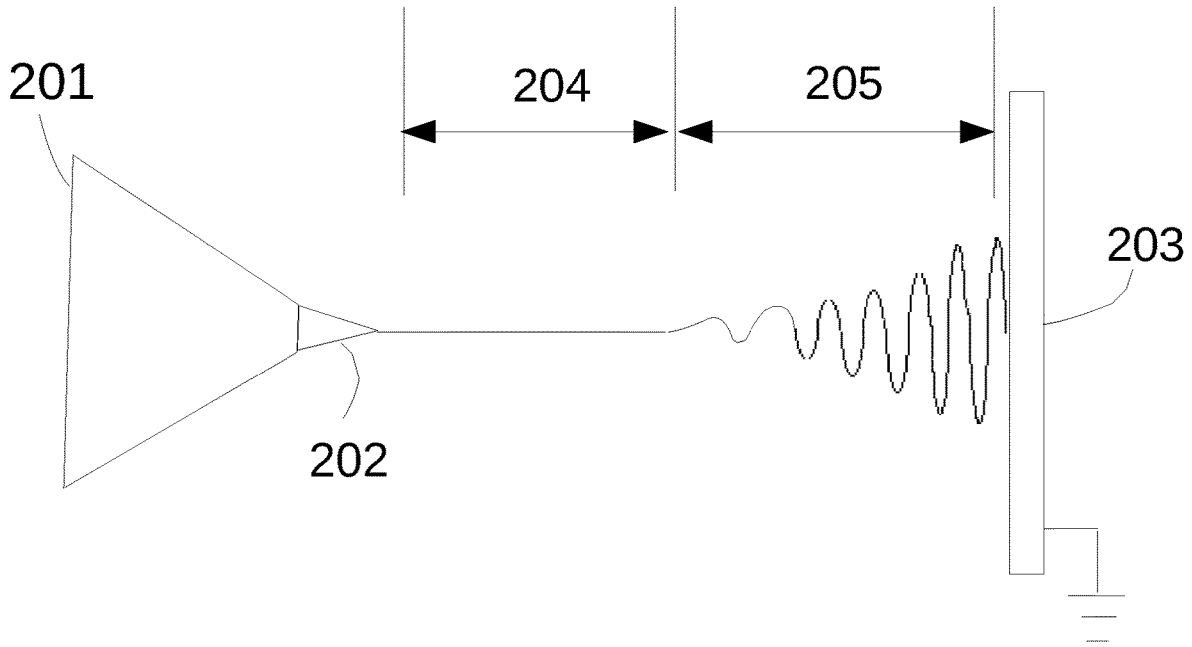
FIG. 2 is a diagram showing the typical technique used for electrospinning nano fibers.

FIG. 2 provides a diagram of a typical electrospinning technique which supports the fabrication of the current invention. This diagram depicts an apparatus that can be used to produce the nanoscale fibers which are part of the fabrication process disclosed with the invention. 201 is an electrospinning nozzle, which has a high voltage applied. The voltage is applied to the nozzle 201 so that the polymer material fed to the nozzle produces a critical point at the end of the nozzle 201, the Taylor cone 202, from which a stream emits and travels toward the cathode 203. The first portion of the path to the cathode 203 experiences ohmic flow 204, where the stream particles are uniformly accelerated towards the cathode 203. Closer towards the cathode 203, the particles of the stream start reacting towards each other as charge migrates outward and a spiraling of the stream becomes a fiber within this region, known as convective flow 205. Depositing of the fiber on the cathode 203 produces mats of nanoscale fibers which can be used further in fabrication of the invention. The details of the electrospinning technique including sizes, voltages, timing, part supplies, and other details of the process which produces a nanoscale fiber for use in current invention are similar to those used by persons skilled in the art or science of electrospinning and its related fields.

Figure 3:
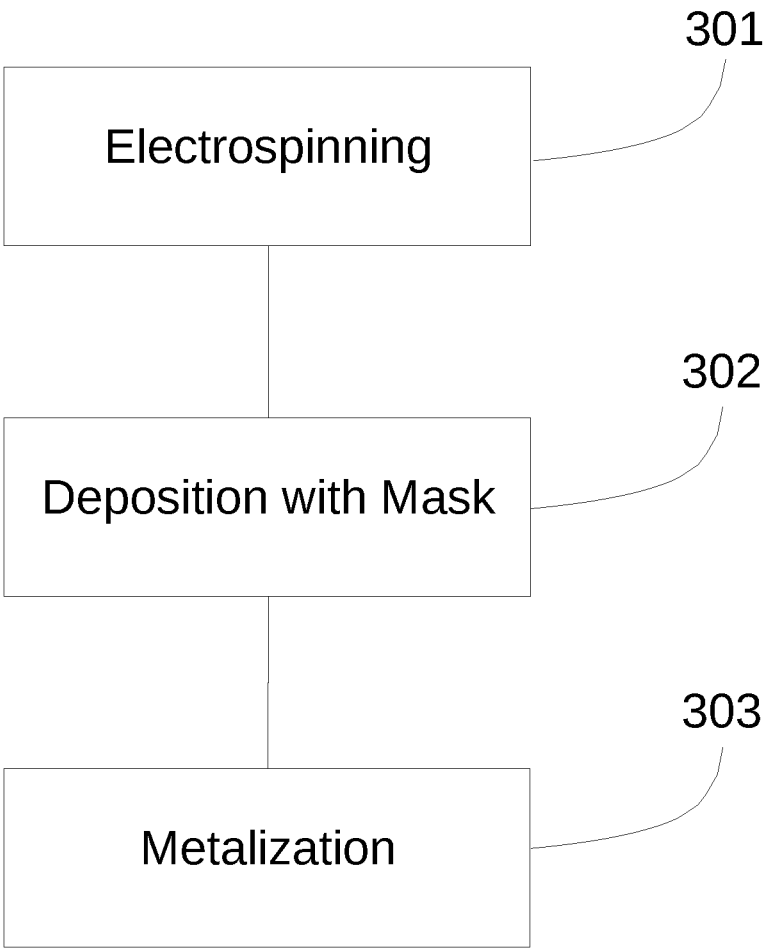
FIG. 3 is block diagram showing the fabrication process of the preferred embodiment of the invention.
Figure 4:
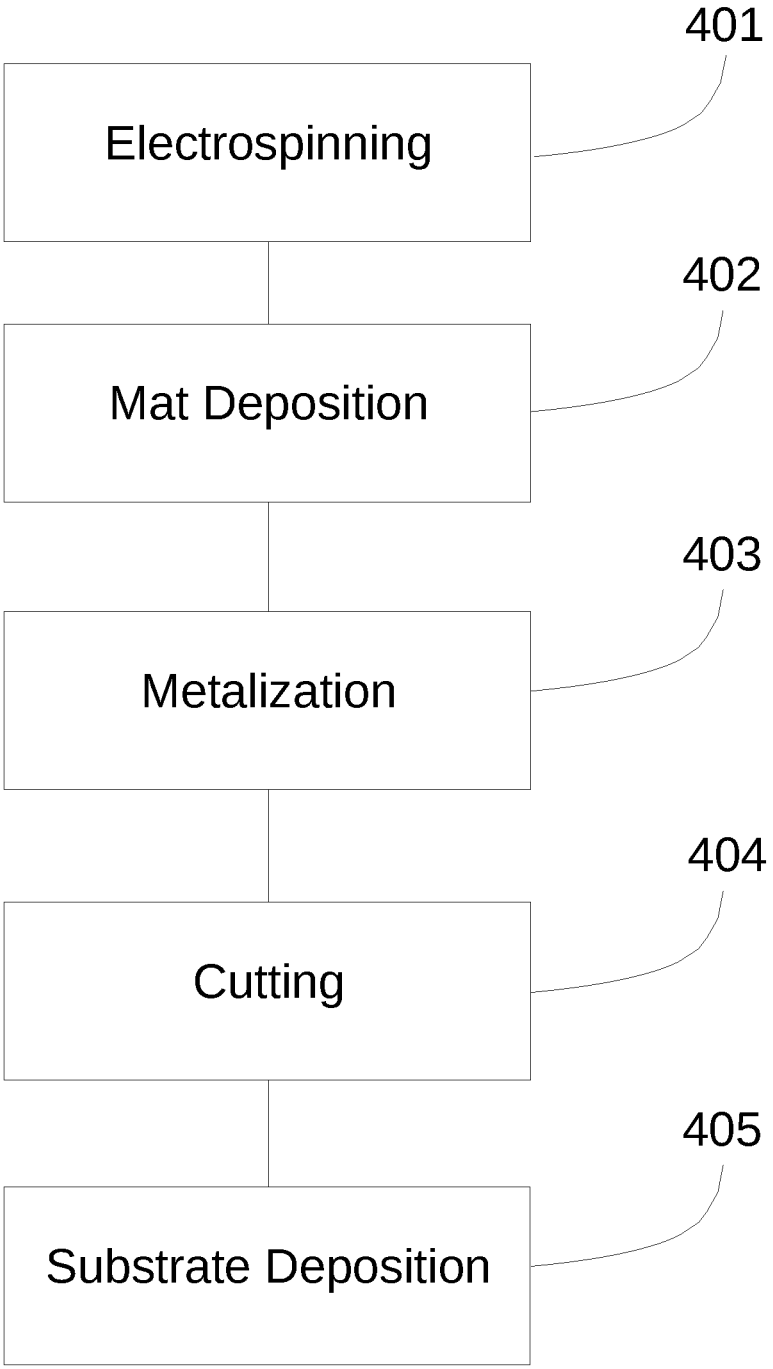
FIG. 4 is a block diagram showing an alternative fabrication process for the invention.

FIG. 3 and FIG. 4 disclose the steps comprising the methods to fabricate the nanoconductor fibers for the invention. FIG. 3 shows the fabrication method for the preferred embodiment of the invention based on an electrospinning technique as that described in FIG. 2. Step 301 uses the electrospinning apparatus to produce the stream of nanoscale fibers from at least one polymer compound. In the preferred embodiment, a polyacrylnitrile (PAN) polymer is used. In the preferred embodiment, the mask Step 302 is used during the deposition of the polymer nanoscale fiber to control the width of the nanoscale fiber deposition. A polymer-based fiber of sufficient strength and size is used to capture the deposit of electrospun nanoscale fiber for this invention. In the preferred embodiment, a polyester fiber made of polyethylene terephthalate (PET) with an average cross-sectional diameter of 150 to 200 microns is fixed between the mask and the cathode of the electorspinning apparatus during Step 302. In other embodiments, multiple mask configurations and polymer fiber substrates may be used during Step 302. Various other polymer materials can be used to produce the nanoscale fibers or as the macroscopic polymer fiber and such material which are obvious to a person skilled in the art are intended to be covered by the instant invention. Following deposition, Step 303 metallizes the nanoscale fibers deposited on the macroscopic polymer fiber using electroplate techniques. In the preferred embodiment, silver is used to metalize the nanoscale fibers in Step 303. Other embodiments can use other metallic materials such as copper, gold, nickel and others. Another embodiment uses carbon as the conductive material added through carbonization in Step 303. Silver metalization is the preferred embodiment because it has superior properties over other metallic compounds and carbon nanoconductors have been found to be harder to deposit on substrates such as the macroscopic fiber of the invention and are more brittle, making them difficult to apply to the invention.

An alternative method for fabricating the nanoconductor structures of the invention is disclosed in FIG. 4. Step 401 uses an electrospinning apparatus as shown in FIG. 2 to create nanoscale fibers from a polymer such as PAN. Step 402 comprises the deposition step of the electrospinning process. In this case, no mask or macroscopic fiber substrate is used as in the preferred embodiment of FIG. 3. Step 402 deposits the nanoscale fibers on a planar substrate without a mask, so that nanoscale fiber mats are created with an approximate size of 10 cm width. In Step 403, the nanoscale fiber mats are metalized through electroplating to create nanoconductor mats. Silver is used in this embodiment for the same reasons as in the preferred embodiment's method in FIG. 3, but other metals could be used in this step as part of other embodiments. Because of the difficulty found when working with the brittle properties of carbonized nanoconductor mats, carbon is not a candidate for the method shown in FIG. 4. The metalized mats are cut in Step 404 to reduce their width to the nano-scale size of the invention. The alternative method disclosed in FIG. 4 has higher risk of damaging the metalized fibers and requires further investigation. Various embodiments of this method which use different means of cutting the nanoconductor mats to reduce the risk of Step 404 are included in the method shown in FIG. 4. Step 405 uses the smaller nanoconductor mats to deposit nanoconductor material on the macroscopic polymer fiber of the invention, which can be the polyester PET fiber. A uniform nanoconductor geometry may be more difficult to achieve with the method of FIG. 4. Various other polymer materials can be used to produce the nanoscale fibers or as the macroscopic polymer fiber and such material which are obvious to a person skilled in the art are intended to be covered by the instant invention.

Figure 5:
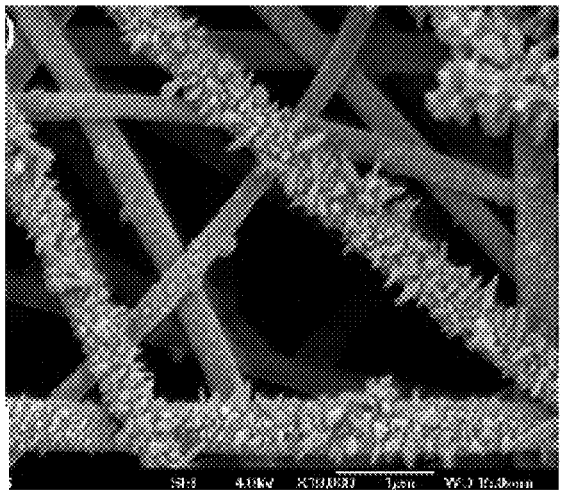
FIG. 5 is an image showing nano fibers produced by electrospinning.

FIG. 5 is an image showing an example of the nanoconductor mats produced through an electrospinning process similar to that disclosed in FIG. 4. This view is an enlarged view of an example which is approximately 10 microns wide, much larger than the nanoconductor geometry expected to be achieved with the preferred embodiment in the method disclosed in FIG. 3. Various mask types and patterns can be used to produce the nanoscale fiber dimensions of the method disclosed in FIG. 3 and all such masks and masking methods which are obvious to a person skilled in the art are intended to be covered by the current invention.

Figures 6A, 6B:
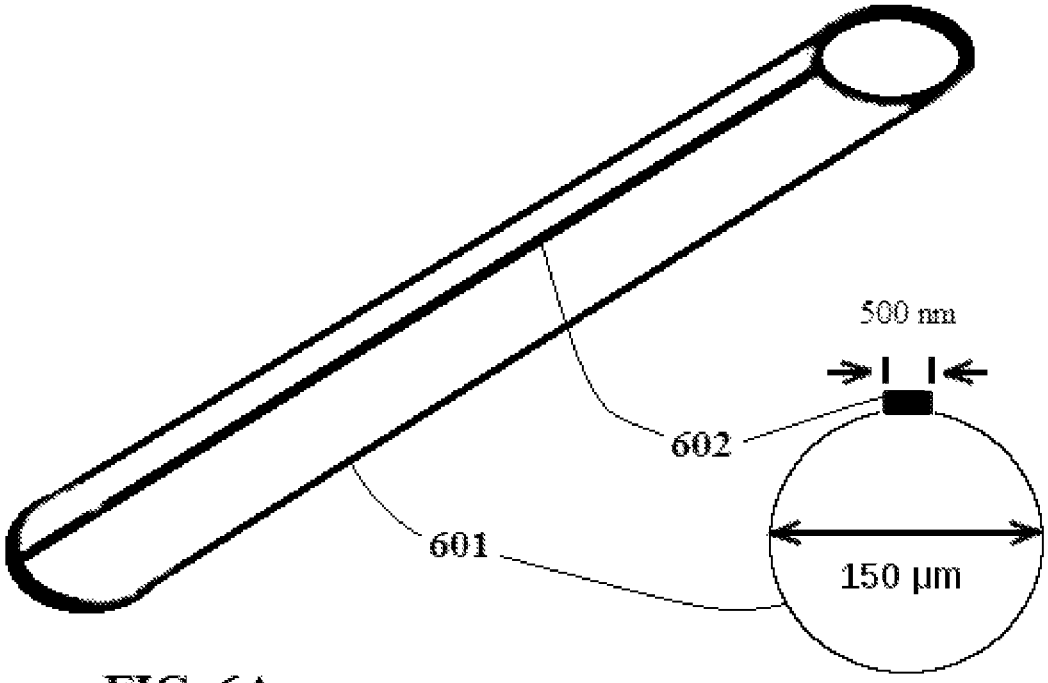
FIG. 6A shows the longitudinal geometry of the nanoconductor fibers.
FIG. 6B shows the cross-sectional geometry of the nanoconductor fibers used in the invention.

FIG. 6A and FIG. 6B show the geometry of the nanoconductor structures produced in the methods disclosed in FIG. 3 and FIG. 4. The longitudinal geometry of the nanoconductor fiber is illustrated in FIG. 6A. FIG. 6B shows the cross-sectional geometry of the same nanodonductor fiber. 601 is the macroscopic fiber used as a final substrate in the methods of FIG. 3 and FIG. 4. In the preferred embodiment, this is a polyester PET fiber of approximately 150 microns as shown in the cross-sectional aspect of FIG. 6B. On top of one cross-sectional hemisphere in FIG. 6B is the nanoconductor strip 602. In the preferred embodiment fabricated using the method disclosed in FIG. 3, this nanoconductor strip 602 is approximately 500 nm wide and runs the length of the macroscopic fiber 601 as shown. The use of a mask in the method disclosed in FIG. 3 provides a high level of control to the deposition of the nanoconductor strip 602 on the macroscopic fiber 601. For this reason, the length of the nanoconductor strip 602 can be tailored to suit the user's application and in alternative embodiments, the nanoconductor strip 602 will not run the whole length of the macroscopic fiber 601 as it is shown in FIG. 6A.

A novel feature of the geometry shown in FIG. 6A and FIG. 6B is that the nanoconductor strip 602 is deposited to only one side of the cross-section of the macroscopic fiber 601. This feature of the geometry supports several novel aspects of the invention, including a novel means of weaving the nanoconductor fibers into the textile, a novel means of connecting the nanoconductor fibers to external conducting surfaces and electronic circuits, and a novel means of creating smart circuits and technology within the garment. The preferred embodiment uses this geometry. The alternative method disclosed in FIG. 4 provides other embodiments in which the nanoconductor strip 602 is not restricted to a single side of the cross-section of the macroscopic fiber 601. Various embodiments based on the position of the nanoconductor fibers on the cross-section of the macroscopic fiber which are obvious to a person skilled in the art are intended be covered by the current invention.

FIG. 7A shows an example of how an apparatus, such as a modified loom, can use the novel geometry of the invention shown in FIG. 6A in order to weave the nanoconductor fibers produced by one of the methods in FIG. 3 or FIG. 4 into a common textile. This approach is best for larger garments when the nanoconductor fibers of the invention will cover most of the length of the material. A rapier loom is preferred because its design allows for modification of the pick which will support the uniform orientation of the invention's nanoconductor fiber's geometry in various embodiments In the preferred embodiment, the invention's nanoconductor fibers are fully integrated into the weave of a poly-cotton blend material with the orientation of the nanoconductor strip facing up. Single or multiple nanoconductor fibers can be inserted in place of some of the warp threads in order to support the interconnection of the nanoconductor fibers within the garment for various smart applications of the invention.

FIG. 7A is a sketch of a single rapier arm loom, which is the preferred embodiment. In the preferred embodiment, 701 is a view of the rapier arm at the point of insertion, drawn not to scale. The rapier arm 701 is shown carrying the weft yarn 702 as it is inserted into the shed 703. A transfer device 704 is attached to the end of the rapier arm 701, which carries a nanoconductor fiber 705 which is fed from the spool 706. The spool 706 is wound so that the nanoconductor fiber 705 is fed to the transfer device 704 in a chosen orientation. The transfer device 704 holds the nanoconductor fiber 705 in a fixed position as it inserts it though the shed 703 so that the nanoconductor fiber can be woven into the weave of the cloth with a fixed orientation. In the preferred embodiment, the nanoconductor strip 602 on the nanoconductor fiber 705 is pointed upwards, but the transfer device 704 and spool 706 allow the loom operator to change the orientation of the nanoconductor fiber 705 to support any other orientation with respect to the plane of the weave. Warp yarn 707 is one of the many warp yarns that are suspended in the loom to create the shed 703 for the rapier arm 701. The warp yarns are suspended through the reed 708, which beets the nanoconductor fiber 705 into the weave after its insertion. The fell and cloth 709 into which the nanoconductor fiber 705 is woven is collected on a takeup roll, which is used as material for a garment comprising the integrated nanoconductor fiber 705. In addition to the nanoconductor fiber 705 in the weft yarn direction, one or more of the warp yarns can be replaced by a warp-directed nanoconductor fiber 710 in order to allow interconnection of nanoconductor fibres within the cloth. One warp-directed nanoconductor fiber 710 is shown in the preferred embodiment of FIG. 7A, but multiple warp-directed nanoconductor fibers 710 can be used in other embodiments.

FIG. 7B through FIG. 7D show different views of the transfer device 704. FIG. 7B shows the back view of the transfer device 704. In this view, the transfer carriage 7101 is shown from the back, with the retaining disk 7102 contained within the transfer carriage 7101. The retaining disk 7102 comprises a thin slot which holds the nanoconductor fiber 705 when the transfer device 704 carries the nanoconductor fiber 705 into the shed 703 of the loom. On each side of the transfer carriage 7101 is a projecting pin 7103, which is used in alternative embodiments to move the transfer device 704 during nanoconductor fiber 705 insertion. The preferred embodiment of the invention does not require the projecting pins 7103 and would not comprise these structures. FIG. 7C shows the front view of the transfer device 704, comprising the transfer carriage 7101, the retaining disk 7102, and the optional projecting pins 7103. The front view in FIG. 7C presents a clearer view of the retaining disk 7102, which is attached within the walls of the transfer carriage 7101. FIG. 7D shows the side view of the transfer device 704. In this view, the transfer carriage 7101 is obvious and the optional projecting pins 7103 are shown on the side of the device. The preferred embodiment does not provide the projecting pins 7103. The retaining disk is not visible when viewing the transfer device 704 from the side, but the nanoconductor fiber 705 which is held by the retaining disk during operation is shown.

FIG. 7E is a close-up view of the top of the retainer disk 7102 with the nanoconductor fiber 705 inserted into the holding slot. This view shows how some embodiments of the invention can include position sensor 7104 probes which are part of a micro-circuit that determines the orientation of the nanoconductor fiber 705 by measuring conductivity of the part of the fiber the probes are contacting. In the preferred embodiment of the invention, the orientation of the nanoconductor fiber 705 is such that the nanoconductor strip 602 is facing up. In this orientation, the position sensor 7104 probes are not contacting the nanoconductor strip 602 so that the conductivity between the probes is lowest. The sensor measurements of the probes are carried back to a meter 7105 through a micro-circuit along the surface of the retaining disk 7102. The connecting interface 7106 is required in the embodiments of the invention which allow movement of the transfer device 704 with respect to the rapier arm 701 and is used to communicate the position sensor 7104 signals to a meter 7105 which is located external to the rapier arm. Communication of the signal in this case can be by voltage transformation, electrical connection through bushings or other contacts which allow movement, or by non-contact means such as wireless or radio frequency signals. The preferred embodiment of the invention does not support movement of the transfer device 704 with respect to the rapier arm 701 and the connecting interface 7106 is not used. Other embodiments can include the connecting interface 7106 and any such connecting interface which is obvious to a person skilled in the art is within the scope of the present invention and covered by its claims. The meter 7105, which can be located separate from the transfer device 704 and provide indication to the loom operator, allows the operator to monitor the insertion of the nanoconductor fiber 705 and provide alarms if the position sensor 7104 senses a change in the orientation of the nanoconductor fiber 705.

The foregoing description disclosed the preferred embodiment of a weaving apparatus, which is based on a single rapier arm loom. Alternative embodiments of the invention include other types of looms or apparatus which can use the transfer device 704 to insert the nanoconductor fiber 705 into the weave of the cloth. Other types of looms which would support these alternative embodiments include projectile, air jet, multiphase and hand looms, and all such looms which are modified to use a device such as the transfer device 704 in any way which is obvious to a person skilled in the art in order to weave the nanoconductor fiber 705 as an integrated part of the cloth are intended to be covered by the scope of the present invention and covered by its claims. Other types of looms which do not allow for the insertion of a fiber in a fixed orientation, such as water jet looms, are not within the scope of the present invention.

The alternative embodiment which is based on a projectile type loom is shown in FIG. 7F. FIG. 7F shows how the transfer device 704 disclosed above for the transfer of the nanoconductor fiber 705 across the weft of the loom can be used with a projectile from a projectile loom. In this view, projectile 7201 is loaded in the pick shoe 7202, which is ready to be launched through the weft by the pick lever 7203. The weft yarn 7204 is attached to the projectile for insertion through the shed. In this alternative embodiment, the transfer device 704 and nanoconductor fiber 705 are attached to the rear of the projectile, which allows insertion of the nanoconductor fiber 705 through the shed with a fixed orientation. In this embodiment, the transfer device 704 can be an attachable device which is removed manually after the projectile arrives on the receiving end of the shed.

The preferred embodiment disclosed above is based on a single rapier arm loom. An alternative weaving apparatus for this invention is a modified dual rapier arm loom. FIG. 7G to FIG. 7H show how the transfer device 704 can be used as part of a dual rapier arm loom to perform the same weaving effect as the preferred embodiment. FIG. 7G is a drawing of the giver arm 7300, which is one of the dual rapier arms used in the alternative embodiment. The invention's transfer device 704 is shown in the default position on top of the giver arm 7300. In the preferred embodiment, the transfer device 704 was fixed on the single rapier arm of that embodiment and did not require the use of the projecting pins 7103. In the alternative embodiment with two rapier arms, the transfer device 704 is designed to move along the longitudinal axis of the giver arm 7300 so that it can be transferred to the other arm in the middle of the shed. The projecting pins 7103 are used to support the movement of the transfer device 704 in the alternative embodiment. Forward of the transfer device 704 and on the side of the giver arm 7300 are two return arms. One return arm 7301 is shown in FIG. 7G. This return arm 7301 is used to engage the projecting pins 7103 after transfer of the transfer device 704, when the giver arm 7300 is returning to the default position. In FIG. 7G, which shows the default position, one return arm 7301 is shown in the down position, which is the default position.

The other rapier arm of the dual rapier arm embodiment is shown in FIG. 7H. In FIG. 7H, the taker rapier arm 7400 is shown with the transfer device 704 and nanoconductor fiber 705 already transferred from the giver arm 7300. The giver arm 7300 of FIG. 7G is not shown in this view. The taker arm pick 7401 and weft yarn 7402 are shown in this figure, although the alternative embodiment would normally not insert a weft yarn at the same time that the transfer device 704 and nanoconductor fiber 705 are being transferred across the shed. Other alternative embodiments may transfer both at the same time as shown in the figure. In FIG. 7H, the taker arm 7400 has just captured the transfer device and carried it away from the giver arm 7300. A capture arm 7403 is shown in this view after it has attached to the projecting pin 7103, shown on the front side of the taker arm 7400 and transfer device 704. The other capture arm 7403 is shown capturing a second projecting pin 7103, which is not in view because it is on the other side of the transfer device 704.

FIG. 7I depicts the operation of the alternative embodiment based on dual rapier arms at the point in time when the giver arm 7300 meets the taker arm 7400 at the middle of the shed. In this case, a capture arm 7403 on each side of the taker arm 7400 attaches to the projecting pin 7103 of the transfer device 704 and transfers the transfer device 704 and nanoconductor fiber 705 away from the giver arm 7300 and onto the top of the taker arm 7400, where the transfer device 704 is carried through the remainder of the shed. This action inserts the nanocunductor fiber 705 through the width of the shed with a fixed orientation. The return arm 7301 of the giver arm 7300 is shown in this figure in its default position (down), where it remains until the transfer device 704 is transferred off the top of the giver arm 7300.

FIG. 7J shows the operation of the return arm 7301 when the transfer device 704 is captured by the taker arm 7400. At this point, the transfer of the transfer device 704 and nanoconductor fiber 705 from the top of the giver arm 7300 allows the deflection plate 7500 to move the return arm 7301 on both sides of the giver arm 7300 from their default (down) position to the "return" position (up) in which they will operate on the return of the transfer device 704. The deflection plate 7500 is a spring loaded plate connected to the return arm 7301 on each side of the giver arm 7300, which moves the arms up into the return position after the transfer device 704 moves past the return arm 7301 default position. In this embodiment, the deflection plate 7500 and return arm 7301 will be returned to the default (down) position after transfer of the nanoconductor fiber 705 across the shed and return of the transfer device 704 to its default position on the giver side of the loom.

FIG. 7K shows the operation of the dual rapier arm embodiment at the point in time when the taker arm 7400 returns the transfer device 704 back to the giver arm 7300. At this time, the nanoconductor fiber has been inserted across the width of the shed and automatically cut from the transfer device 704 when the taker arm started to return to the center of the loom. The capture arm 7403 has released the projecting pin 7103 on the taker arm side of the transfer device 704. On the giver arm 7300, the return arm 7301 on both sides of the giver arm 7300 have been placed in their return position (up) and attach to the projecting pin 7103 on the giver side of the transfer device 704 in order to transfer the transfer device 704 back to the giver arm 7300. The transfer device 704 and giver arm 7300 travel in this position back to the giver side of the loom, where the transfer device 704 and return arm 7301 on each side of the giver arm 7300 can be reset to their default position. Manual or automated means to return the giver arm 7300, return arms 7301 and transfer device 704 to their default position which are obvious to a person skilled in the art are intended to be covered by the current invention.

FIG. 7L shows an actuator mechanism which is used in the alternative embodiment based on dual rapier arm looms. This actuator will translate the position of the return arm 7301 of the giver arm 7300 to a linear force which actuates the release of the capture arm 7403 of the taker arm 7400. Conversion of the rotational motion of the giver's return arm 7301 is translated to linear motion by a rack 7600 and pinion 7601 mechanism, which applies linear force on an actuator shaft 7602 when the spring action of the deflection plate of the giver arm 7300 moves the giver's return arm 7301 to its return (up) position. The translated actuator shaft 7602 is in an extended position when the taker capture arm 7403 returns with the taker arm 7400. An actuator lever 7603 is attached to the taker arm 7400 such that the extended actuator shaft 7602 of the giver arm 7300 can move the actuator lever when the rapier arms meet. The movement of the actuator lever 7603 operates on the capture arm 7403 on the side of the taker arm 7400 and causes the capture arm 7403 to move up and release the transfer device 704 so that the return arm 7301 can attach to the projecting pin 7103 of the transfer device 704 and return the transfer device 704 to the giver arm 7300.

The apparatus embodiments presented in FIG. 7A through FIG. 7L support embodiments of the invention which cover the extent of a user's garment, with the nanoconductor fibers of the invention fully integrated in the length of the garment. An alternative embodiment of the invention comprises a smaller area of the garment in which the nanoconductor fibers and smart application of the invention is fully integrated with only one area of the garment. In this case, the nanoconductor fibers of the invention can be integrated with the garment through darning as one embodiment of the alternative application. FIG. 8 shows an example of how the invention's nanoconductor fibers and electronic application can be integrated with the fabric by darning. In this embodiment, 801 is the area of the garment which has been opened for integration of the invention's nanoconductor fibers and supporting material. 802 are two or more nanoconductor fibers which have been integrated in this area as part of the dam. The 803 supporting material are other fibers, such as poly-cotton blend, which are darned into the same area as the invention's nanoconductor fibers. Other darning methods for fully integrating the invention's nanoconductor fibers and smart applications into a region of a cloth which are obvious to a person skilled in the art are intended to be covered by the current invention.

Yet another alternative embodiment of the invention which uses a different method to fully integrate the nanoconductor fibers and technology of the invention within the weave of the user's garment is a single pull needle approach. FIG. 9 shows and example of how the invention's nanoconductor fibers and technology can be pulled through a portion of the garment using a needle and by manually weaving the needle between the weave of the garment. 901 represents the area of the garment into which the invention is integrated. 902 is a nanoconductor fiber of the invention which has already been integrated with the garment. 903 shows a needle which is used to pull another nanoconductor fiber 904 through the weave of the garment. This example only shows two elements of the invention integrated in the user's garment, but other embodiments can include more nanoconductor fibers in various directions and orientations such that the invention creates a smart application based on the integrated nanocondcutor fibers and electronics. The number, orientation and arrangement of the invention's nanoconductor fibers and smart application based on this approach which are obvious to the person skilled in the art are intended to be covered by the current invention.

Embodiments of the invention which include various ways to fully integrate the nanoconductor fiber and tecnology of the invention with a wearable garment have been disclosed herein. Although some specific examples and designs for apparatus and other methods which can be used to fully integrate the invention with wearable apparel have been given, the intention of this invention is to cover all apparatus and means which can be used to integrate the invention into a wearable fabric or garment and which are obvious to anyone skilled in the art. Such other apparatus and means of integration of the invention into a wearable fabric or garment are within the scope of the invention and are intended to be covered by its claims.

FIG. 10 discloses how the geometry of the invention's nanoconductor fibers support novel ways to connect the nanoconductor fiber circuits in the garment with external conducting surfaces, leads or circuits. 1001 is a woven cloth portion of an article of clothing in which the invention's nanoconductor fibers 1002 and 1003 have been fully integrated with the weave of the cloth. In this drawing, the space between the weave is exaggerated to aid in discussion. In the embodiment shown in the example of FIG. 10, nanoconductor fiber 1002 is oriented so that the nanoconductor strip 602 of this fiber is facing up (not shown). The orientation of nanoconductor fiber 1003 is such that its nanoconductor strip 602 is facing down, as shown in the close-up view of FIG. 10. Connectors 1004 are depicted in FIG. 10 to show how the geometry of the nanoconductor fibers allow the conducting circuit of individual nanoconductor fibers 1002 and 1003 to make contact with a single connector depending on the orientation of each fiber. The connectors 1004 allow external circuits to connect to individual or multiple nanoconductor fibers of the invention through the leads 1005 shown in the figure. The novel connection feature of the invention shown in FIG. 10 demonstrates the preferred embodiment of how connections are made to the smart circuits comprising the integrated nanoconductor fibers of the invention because this method of connection does not require changes to the woven nanoconductor fibers after they are sewn into the garment. Other embodiment of connectors for the invention may require alternations or some changes to the weaving or orientation of the nanoconductor fibers in order to make contact with them.

FIG. 11 is an alternative embodiment for connecting the nanoconductor circuits of the invention to external conductors or circuits. In this example, the nanoconductor fiber 1101 wraps around the connector 1102, supporting a connection to an external device or circuit through a novel geometry which allows electrical contact similar to wrapped wires. The lead 1103 can be a soldered wire or other connection made to the connector from an external circuit. Other embodiments comprising connectors allowing connection to the invention's nanoconductor fibers and smart applications in addition to those disclosed in FIG. 10 and FIG. 11 which are obvious to a person skilled in the art are intended to be covered by the current invention.

In FIG. 12, different configurations of the nanoconductor fibers of the invention are shown with their electrical equivalents. 1201 is a nanoconductor fiber produced by a modified method of fabrication to that shown in FIG. 4 in which the size of the nanoconductor strip 602 is larger at a point in order to increase the resistance at that point. This higher resistance portion of the nanoconductor fiber is represented by a resistor 1202 in the circuit containing the modified nanoconductor fiber. Similarly, nanoconductor fiber 1203 is an example of how a capacitive element can be introduced into the smart circuits of the invention. The capacitor 1204 is how the nanoconductor fiber 1203 would be represented in a circuit representation of the invention's application.

The current invention comprises smart applications which can only be achieved using the novel geometry and integration of the nanoconductor fibers with the fabric of the garment. One embodiment of the invention's smart applications is based on a configuration of multiple nanoconductor fibers within a region of a garment which provides power to smart components integrated with the wearable electronics of the invention. The "smartness" of these applications relates to the ability to tailor the invention's capabilities to the user's intended use of the integrated, nanoconductor circuit. In one embodiment, the invention allows the micro-miniature electronic components to be added as discrete components during integration with the garment in order to tailor the invention to support a specific application for the user. An alternative embodiment allows micro-miniature logic circuits to be integrated with the nanoconductor power runs such that the function of those devices can be reconfigured by the user for specific applications.

FIG. 13 is a schematic showing how the nanoconductor fibers which are integrated in the cloth can be used to define an electronic circuit with smart applications based on discrete micro-miniature electronic components. In the embodiment of FIG. 13, pairs of nanoconductor fibers 1301 can be woven in parallel to distribute power along the length of the wearable electronic circuit. If a small positive voltage is applied to one of these nanoconductor fibers 1301 and the other conductor is grounded or pulled negative, the more positive voltage serves as VDD for an electrical circuit of micro-miniature components, which comprise one or more smart applications. In one embodiment, the more negative voltage is set to ground or 0 volts, but others can apply a non-zero voltage to the more negative nanoconductor as long as it is more negative than the VDD nanoconductor. Between the pair of nanoconductor fibers 1301, discrete micro-miniature components can be added to create applications which are tailored for different uses by the user. FIG. 13 shows one embodiment where a smart application for individual medical monitoring is made up of a temperature sensor 1302, operational amplifier (hereinafter "op amp") 1303 and a signaling LED 1304. Each of these components is attached to the VDD and ground runs for power. FIG. 13 also shows how voltage dividers can be configured between the VDD and ground runs and the resulting voltage is applied to the input of the op amp 1303 in this embodiment. Also shown in FIG. 13 are additional discrete components which support additional functions as part of the invention that is integrated with the garment. In this embodiment, a micro-miniature capacitive sensor button 1305 and capacitive sense module 1306 (hereinafter "capsense button"), an electronic timer circuit 1307, and LED 1308 is shown as a second group of discrete components which create a smart application tailored to a specific application of the user. These discrete components can be designed to display an alert signal that provides a blinking light to observers when the user presses the capsense button. Other examples of micro-miniature circuits that can be supported by the design of the invention shown in FIG. 13 which are obvious to a person skilled in the art are covered by the current invention as additional smart applications which can be used with the invention. The applications shown in FIG. 13 are examples of the most rudimentary smart application of the invention. In this embodiment, discrete micro-miniature components can be added to the nanoconductor circuit of FIG. 13 to tailor the invention to specific uses of the garment at the time that the invention is integrated into the garment. This embodiment also covers the removal or replacement of discrete components after the integration of the invention to allow other uses of the garment.

An alternative embodiment creates smart applications in the current invention based on the 2 power rail design shown in FIG. 13, but using logic components which can be integrated in the garment and reconfigured later to support different applications and uses. FIG. 14A shows an example of this alternative embodiment of the invention's smart applications. As in FIG. 13, FIG. 14A shows a VDD nanoconductor fiber rail 1401 and VSS nanoconductor fiber rail 1402. Between the power rails are discrete logic components which are connected to other loads within the circuit. In this embodiment, a number of components are grouped between the power rails for the purpose of performing a specific application for the user. One group shown in FIG. 14A is an example designed for a personal monitoring application. This group comprises a configuration input component 1403, a temperature sensor 1404 and op amp 1405, and an LED output 1406. The configuration input component 1403 is one of various components which can enable or disable the other components within the group. For example, FIG. 14B shows one such configuration input component 1403 in this embodiment, which is comprised of a capsense button 1407 a capacitive sensor module 1408, and a logic component 1409, which disables or enables the signals from the other components if the button is pressed. The configuration input component 1403, is connected to the VDD nanoconductor fiber rail 1401 and VSS nanoconductor fiber rail 1402 for power as shown in FIG. 14A. With this type of configuration input component 1403, the capsense button 1407 can be pressed by a clinical technician in order to enable the other components and provide a temperature sensor function in this part of the garment. Similarly, the capsense button 1407 of the configuration input component 1403 can be pressed a second time in order to disable the other components in the group and prevent temperature sensing in this part of the garment. When temperature sensing is enabled, the smart application of this embodiment of the invention will light the LED output 1406 when the wearer's temperature exceeds a threshold established at the input of the op amp 1405.

FIG. 14A includes an example of a second group comprising a second configuration input component 1410, a humidity sensor 1411 and op amp 1412 used to detect perspiration, and a second LED output 1413. As in the case of the first group of this embodiment, the configuration input component 1410 is comprised of the same components of FIG. 14B and can be used by the clinical technician to disable or enable the perspiration sensing function. When enabled, this embodiment of the invention allows the sensing of perspiration near the cloth in which it is integrated and lights the LED output 1413 to alert the nurse or technician when the sensor is above a pre-determined threshold. By adding a number of similar groups of configurable components at the time of fabrication, the application of the invention can be tailored to the specific use of the user after fabrication by making appropriate inputs into selected parts of the invention's configuration inputs. By allowing configuration and re-configuration of the circuits which are integrated with the invention, the embodiment shown in FIG. 14A provides a "smarter" application than that shown in FIG. 13, which has to be configured at time of fabrication and cannot be reconfigured later in life like the smart application in FIG. 14A. This embodiment of the invention discloses a smart application approach for use of the invention which includes any number and type of configurable components that are obvious to a person skilled in the art, all such combinations and types being intended to be covered by the current invention.

Another embodiment of the invention's smart applications, which is the preferred embodiment, is based on a lattice 1500 of nanoconductor fibers that have been integrated with a garment and programmable components which are integrated in the lattice 1500. FIG. 15A shows an example of the preferred embodiment, where programmable nodes are distributed over the region of the nanoconductor fiber lattice 1500. The lattice 1500 would be connected to a configuration master 1501 which drives the configuration of the nodes in the lattice 1500. The configuration master 1501 can be a user input device or a processor which receives configuration inputs through another interface. In the preferred embodiment, the configuration master 1501 is a processor which provides a RS-485 master function and is connected to all of the nodes through a separate pair of nanoconductor fibers comprising an RS-485 bus 1502. The RS-485 bus 1502 of this embodiment is not shown in FIG. 15A. In this embodiment, each node would comprise one or more components that are connected to the other nodes by the nanoconductor fiber lattice 1500 and which support a particular function. FIG. 15B is a close-up view of a node in this lattice 1500, which shows the RS-485 bus 1502, a communication component 1503, a configurable logic component 1504, an active component 1505, and an output component 1506. The logic component 1504 supports logic states which enable or disable the other components of that node. The purpose of the communication component 1503 is to receive inputs from the configuration master 1501, which in the preferred embodiment, is a serial input from the RS-485 master, communicated over the RS-485 bus 1502. The communication component 1503 will drive the logic component 1504 to a true or false condition based on the serial input from the configuration master 1501. In the preferred embodiment, the node's communication component 1503 will act as an RS-485 slave device and will toggle the state of the logic component 1504 when the configuration master 1501 sends a command to the slave. Although the preferred embodiment discloses communication between the configuration master 1501 and communication components 1503 at the nodes of the lattice 1500 using serial communications based on RS-485, other communications methods are possible in alternative embodiments. For example, a serial communications circuit which allows addressing of the communication components 1503 at the nodes of the lattice 1500 similar to how boundary scan testing is performed with JTAG interfaces can be used to connect to and configure the configurable logic component 1504 of an alternative embodiment. Any similar communications connection and protocol which supports communications between the configuration master 1501 and the communication components 1503 at the nodes of the lattice 1500 and are obvious to a person skilled in the art is intended to be covered by the current invention.

In the preferred embodiment, the RS-485 connection between the configuration master 1501 and nodes of the lattice 1500 allow for the smart application of the invention to be programmed by configuration signals to individual nodes. The communication component 1503 of each node is connected to two nanoconductor fibers that provide the RS-485 bus 1502 as shown in FIG. 15C. The lattice of nanoconductor fibers 1500 which provides a power connection to each node is not shown in FIG. 15C. The RS-485 configuration master 1501 addresses each node individually using a serial protocol such as Modbus over the RS-485 bus 1502. Repeater nodes 1507 are placed at the end of rows of the lattice 1500 so that the serial signal from the configuration master 1501 can be transmitted to the next row. Termination resistors 1508 matched to the characteristic impedance of the signaling lines, which are based on nanoconductor fibers fabricated with resistance as shown in FIG. 12, can be used to reduce reflections in the serial network created by the RS-485 bus 1502. In the preferred embodiment which uses this design, the configuration of the individual nodes can be "programmed" to enable active nodes and disable nodes, in order to achieve a smart application of the invention tailored for the intended use.

In FIG. 15B, the active component 1505 of each node is enabled or disabled by the logic signal of the node's logic component 1504. The purpose of the active node 1505 is to provide an application specific function to the point in the garment located at the node. An example of an active component 1505 is a temperature sensor which provides a signal to the output component 1506. The output component can be an LED output, which is used as an alert signal, or an analog-to-digital converter, which outputs a digital value for the temperature of the user's body at that node. A temperature sensor outputting to an LED is the preferred embodiment, but other types and combination of active components 1505 and output components 1506 which are obvious to a person skilled in the art are intended to be covered by other embodiments of the invention. In the preferred embodiment of the invention, the active component 1505 is the same at each node of the lattice 1500. In this case, the smart application of the invention supports the user re-configuration of the number and location of active components 1505 which are enabled. For example, if one side or region of the lattice 1500 is of interest to the user's application, the user can set the configuration of the active components 1505 to enable the nodes in the area of interest. In other embodiments, the active component 1505 can vary between the nodes of the lattice 1500 and can include a number of devices which support various functions. The smart application in these embodiments will allow an individual garment to be used for a specific user's application and another garment of the same design to be configured for a different use.

An alternative embodiment of the invention's smart applications is shown in FIG. 16A, where capsense buttons 1601 are used as the active component of the invention's lattice 1602. The drawing of FIG. 16A is not a detailed schematic and only shows a single line connection between nodes and devices, such lines representing two or more nanoconductor fibers for power or serial communication circuits as required by the connected device. In this embodiment, the user can enable different regions of the garment to use the capsense buttons in those areas as user input. An output component 1603 which outputs the values of the buttons pressed to a user interface device 1604 would allow those regions of the invention's lattice which are enabled to serve as keypad input devices. Two examples of active keypad inputs in this embodiment are shown in FIG. 16B and FIG. 16C. In FIG. 16B, the capsense buttons 1601 are placed in a typical arrangement for a keypad 1605. In this case, a single button is pressed at a time to enter a single, fixed value. The alternative example in FIG. 16C shows how a number of capsense buttons 1601 can create a drawing surface 1606, allowing the use of a finger or capacitive stylus 1607 to draw a character for input. In this example, the character is drawn by a finger and the path traced by the finger is shown as highlighted in the view. The highlighted character in this example is for illustration only as the invention is not expected to change the color or lighting of the drawing surface 1606. This embodiment would support alphanumberic characters as well as different glyphs for multiple languages. Other arrangements of capsense buttons 1601 as part of a drawing surface 1606 in varying width, height, order or shape for the purpose of capturing user input of alphanumeric characters or other input which is obvious to a person skilled in the art is intended to be covered by this invention. The embodiment is an example of a lattice 1602, which provides smart applications based on nodes of the same type.

Another alternative embodiment of the invention is based on a lattice with nodes supporting different functions. FIG. 17A shows a smart application of the invention which provides for command of a Unmanned Air Vehicle, UAV 1701, from a ground operator 1702. FIG. 17B shows a close-up of the garment worn on the arm of the operator 1702 which contains a lattice comprising active components 1703 based on accelerometers sensing horizontal direction movement (parallel to the ground) and output components 1704 with LEDs. Other active components within the lattice which are not configured as enabled by the invention are not shown. The purpose of this smart application is to allow the ground operator 1702 to control the UAV 1701 through arm gestures and light signals from the LEDs. In this embodiment, the outputs of the accelerometer active components 1703 drive the outputs of the LED output components 1704 so that when the ground operator 1702 moves his arms in the horizontal direction, the light is emitted by a pattern of LED output components 1704 as shown in FIG. 17B. In this embodiment, the LED output components 1704 are infrared LEDs which are visible to the UAV 1701 by use of an infrared sensor and which would not be visible to an observer who is not equipped to view such signals. In the view of FIG. 17C, the same embodiment of the invention is shown, where accelerometer active components 1705 which sense a different arm motion in the z-direction (up and down motion) are used at different nodes to drive the LED output components 1704 at those nodes and provide a different light pattern to the UAV 1701, for a different arm gesture. This is an example of the embodiment of the invention's smart applications based on having nodes of different types. The type of output signal and pattern shown in FIG. 17B and FIG. 17C are for one embodiment and other types of output components, signals, patterns, arrangements and number which can be integrated with the clothing as part of this invention and are obvious to a person skilled in the art are intended to be covered by the invention.

The foregoing disclosure has described the current invention in considerable detail, including a preferred embodiment or embodiments. Notwithstanding this fact, other embodiments of the current invention are possible. Therefore, the spirit and scope of the accompanying claims should not be limited to the preferred or other embodiments disclosed herein. Unless the accompanying claims explicitly contain the phrases "means for" or "step for", the provisions of 35 USC § 112(f) are not intended and 35 USC § 112(f) should not be applied to interpret the claim's limitations. All features described in this specification and its accompanying claims, abstract, and drawings may be replaced by an alternative feature which serves the same purpose or a similar purpose, unless explicitly stated otherwise.

What is claimed:

1. A weaving apparatus comprising:

a support frame;

a plurality of heddles attached to the support frame;

wherein the heddles hold warp threads in an alternating manner to create a shed through which a weft fiber can be inserted;

a weft insertion device connected to the support frame and positioned at the opening of the shed so that it can travel across the shed to the opposite side of the support frame;

a weft fiber feeding system mounted on the support frame;

a transfer device connected to the weft insertion device;

a retaining ring which is attached to the transfer device;

wherein the retaining element picks a weft fiber from the weft fiber feeding system and holds the weft fiber in a fixed orientation as it travels with the weft insertion device;

a fiber removal system connected to the support frame on the side opposite the weft insertion side;

wherein the fiber removal system removes the weft fiber from the retaining ring of the transfer device when the transfer device and weft insertion device reach the side opposite of the insertion point;

wherein the weft fiber is placed into the weave of the warp yarns in said fixed orientation after removal from the retaining ring and the transfer device and weft insertion device return to the insertion point for picking another weft fiber.

2. The apparatus of claim 1 wherein the weft insertion device is a rapier arm.

3. The apparatus of claim 1 wherein the weft insertion device is a projectile loom projectile.

4. The apparatus of claim 1 wherein the retaining ring is accessible and can be loaded with a weft fiber by hand before insertion.

5. The apparatus of claim 1 wherein the weft fiber feeding system is an automatic feed which places the weft fiber into the retaining ring in a fixed orientation before insertion without manual intervention.

6. The apparatus of claim 1 wherein a second weft yarn is carried by the weft insertion device for transfer across the shed without a fixed orientation.

7. A weaving apparatus comprising:

a shuttleless loom;

a weft insertion device attached to the shuttleless loom;

a weft fiber feeding system attached to the shuttleless loom which feeds weft fiber to the weft insertion device;

a transfer device connected to the weft insertion device which traverses the shed of the shuttleless loom;

a retaining disc which is attached to the transfer device;

wherein the retaining disc holds a weft fiber in a fixed orientation as it travels through the shed;

wherein the transfer device and retaining disc draw the weft fiber through the shed of the shuttleless loom to the other side of the shuttleless loom in said fixed orientation, release the fiber in said fixed orientation and return to the weft insertion device's original position.

8. The apparatus of claim 7 further comprising a weft fiber measurement system attached to the apparatus for measuring the position and orientation of the weft fiber as it is translated through the shed.

9. The apparatus of claim 8 wherein the weft fiber measurement system further comprising:

a microcircuit mounted on the retaining disc and transfer device;

a plurality of sensors which are part of said microcircuit and are mounted on the retaining disc for measurement of the weft fiber's position;

a signaling circuit mounted on the shuttleless loom for transmitting the measurement signals to external monitoring or display equipment;

a means of connection between said microcircuit mounted on the transfer device and said signaling circuit;

an external monitoring or display connector attached to the shuttleless loom and connected to the signaling circuit;

wherein the said means of connection between the microcircuit and said signaling circuit transfers the signal from said plurality of sensors to said external monitoring or display connector when the transfer device is moving through the shed of the apparatus.

10. The apparatus of claim 9 wherein the means of connection between the microcircuit mounted on the transfer device and the signaling circuit is an electrical connection through one or more bushings.

11. The apparatus of claim 9 wherein the means of connection between the microcircuit mounted on the transfer device and the signaling circuit is a wireless network comprising a wireless transmitter and a wireless receiver.

12. The apparatus of claim 9 wherein the means of connection between the microcircuit mounted on the transfer device and the signaling circuit is a communications link comprising a radio transmitter and a radio receiver.

13. The apparatus of claim 7 wherein the shuttleless loom is a single arm rapier type loom.

14. The apparatus of claim 7 wherein the shuttleless loom is rapier type loom having two or more arms.

15. The apparatus of claim 7 wherein the shuttleless loom is a projectile type loom.

16. A weaving apparatus comprising:

one of the following shuttleless looms:

a loom with a single rapier arm;

a rapier loom with at least two rapier arms;

a projectile loom;

a weft insertion device attached to the shuttleless loom;

a weft fiber feeding system attached to the shuttleless loom which feeds weft fiber to the weft insertion device;

a transfer device connected to the weft insertion device which traverses the shed of the shuttleless loom;

a retaining disc which is attached to the transfer device;

wherein the retaining disc holds a weft fiber in a fixed orientation as it travels through the shed;

a microcircuit integrated with the retaining disc, transfer device, and weft insertion device;

a plurality of sensors which are part of said microcircuit and are mounted on the retaining disc for measurement of the weft fiber's position;

a signaling circuit mounted on the shuttleless loom for transmitting the measurement signals to external monitoring or display equipment;

an electrical connector mounted on the shuttleless loom and connected to the signaling circuit to allow for external monitoring or display of the weft fiber's position;

wherein the measurements from the plurality of sensors are communicated through the microcircuit, the signaling circuit and the electrical connector to an external device such that the position and orientation of the weft fiber can be monitored or displayed as the weft insertion device travels through the shuttleless loom;

wherein the transfer device and retaining ring draw the weft fiber through the shed to the other side, release the fiber and return to the weft insertion device's original position.

17. The apparatus of claim 7 wherein the shuttleless loom is a dual rapier arm loom, further comprising:

a giver arm attached to the shuttleless loom on the side of the weft fiber feeding system;

a taker arm attached to the shuttleless loom on the side opposite of the weft fiber feeding system;

a transfer device fitted to the giver arm in its default position on the weft fiber feeding system side of the loom;

wherein the transfer device slides longitudinally along the frame of the giver arm;

one set of projecting pins, the taker projecting pins, attached to the taker arm side of the transfer device;

a number of capture arms attached to the taker arm;

wherein the capture arms capture the taker projecting pins when the giver arm meets the taker arm in the middle of the shed of the shuttleless loom and the transfer device travels with the taker arm after capture, drawing the retainer disc and weft fiber through the width of the shuttleless loom's shed;

a spring loaded deflection plate attached to the giver arm;

a number of return arms connected to the deflection plate which are operationally associated with the deflection plate such that when the deflection plate is down with the spring compressed, the return arms are down and when the spring forces the deflection plate up, the return arms are raised into their return position;

wherein the default position of the return arms and deflection plate is the down position when the transfer device is on the giver arm at the side of insertion and the return arms and deflection plate move to the up position when the transfer device moves from the giver arm to the taker arm after the arms meet in the middle of the shed;

a pinion connected to the hub of at least one of the return arms;

a rack engages the pinion and the operation of the pinion on the rack translates the rotation of the return arms to a linear movement of the rack such that the rack moves along the longitudinal direction of giver arm;

an actuator shaft connected to the rack which moves linearly along the longitudinal direction of the giver arm such that the actuator shaft extends beyond the end of the giver arm when the return arms move to the up position;

an actuator lever attached to the taker arm such that the extended actuator shaft of the giver arm can move the actuator lever when the giver arm and taker arm meet;

wherein the actuator lever is operationally associated with the capture arms of the taker arm such that when the actuator lever is moved by the extended actuator shaft of the giver arm, the capture arms move and release the taker projecting pins on the transfer device;

a set of projecting pins, the receiver projecting pins, connected to the giver side of the transfer device such that when the giver arm and taker arm meet, the return arms are in a position to capture the receiver projecting pins and return the transfer device to the giver arm.

18. The apparatus of claim 17 wherein the number of capture arms is 2.

19. The apparatus of claim 17 wherein the number of return arms is 2.

20. A loom of dual rapier arm type comprising:

a giver arm attached to the loom on the side where the weft fiber is fed to the loom;

a taker arm attached to the loom on the side opposite of the weft fiber feeding system;

a transfer device connected to the giver arm device which traverses the shed of the loom;

a weft fiber feeding system attached to the loom which feeds weft fiber to the transfer device on the giver arm;

a retaining disc which is attached to the transfer device;

wherein the transfer device is fitted to the giver arm in its default position at the weft fiber feeding side of the loom so that a weft fiber is fed into the retaining disc;

wherein the retaining disc holds a weft fiber in a fixed orientation as it travels through the shed;

one set of projecting pins, the taker projecting pins, attached to the taker arm side of the transfer device;

one or more capture arms attached to the taker arm;

wherein the capture arms capture the taker projecting pins when the giver arm meets the taker arm in the middle of the shed of the loom and the transfer device can slide longitudinally along the frame of the giver arm such that it travels with the taker arm after capture, drawing the retainer disc and weft fiber through the width of the loom's shed;

a spring loaded deflection plate attached to the giver arm;

one or more return arms connected to the deflection plate which are operationally associated with the deflection plate such that when the deflection plate is down with the spring compressed, the return arms are down and when the spring forces the deflection plate up, the return arms are raised into their return position;

wherein the default position of the return arms and deflection plate is the down position when the transfer device is on the giver arm at the side of insertion and the return arms and deflection plate move to the up position when the transfer device moves from the giver arm to the taker arm after the rapier arms meet in the middle of the loom's shed;

a pinion connected to the hub of at least one of the return arms;

a rack engages the pinion and the operation of the pinion on the rack translates the rotation of the return arms to a linear movement of the rack such that the rack moves along the longitudinal direction of giver arm;

an actuator shaft connected to the rack which moves linearly along the longitudinal direction of the giver arm such that the actuator shaft extends beyond the end of the giver arm when the return arms move to the up position;

an actuator lever attached to the taker arm such that the extended actuator shaft of the giver arm can move the actuator lever when the giver arm and taker arm meet;

wherein the actuator lever is operationally associated with the capture arms of the taker arm such that when the actuator lever is moved by the extended actuator shaft of the giver arm, the capture arms move and release the taker projecting pins on the transfer device;

a set of projecting pins, the receiver projecting pins, connected to the giver side of the transfer device such that when the giver arm and taker arm meet, the return arms are in a position to capture the receiver projecting pins and return the transfer device to the giver arm.

21. The loom of claim 20 further comprising:

a microcircuit mounted on the retaining disc and transfer device;

a plurality of sensors which are part of said microcircuit and are mounted on the retaining disc for measurement of the weft fiber's position;

a signaling circuit mounted on the loom for transmitting the measurement signals to external monitoring or display equipment;

a means of connection between said microcircuit mounted on the transfer device and said signaling circuit;

an external monitoring or display connector attached to the loom and connected to the signaling circuit;

wherein the said means of connection between the microcircuit and said signaling circuit transfers the signal from said plurality of sensors to said external monitoring or display connector when the transfer device is moving through the shed of the apparatus.

22. The loom of claim 21 wherein the means of connection between the microcircuit mounted on the transfer device and the signaling circuit is an electrical connection through one or more bushings.

23. The loom of claim 21 wherein the means of connection between the microcircuit mounted on the transfer device and the signaling circuit is a wireless network comprising a wireless transmitter and a wireless receiver.

24. The loom of claim 21 wherein the means of connection between the microcircuit mounted on the transfer device and the signaling circuit is a communications link comprising a radio transmitter and a radio receiver.

25. The apparatus of claim 1 wherein one or more warp threads are fed and held in a warp yarn direction fixed orientation.

26. The apparatus of claim 7 further comprising:

one or more heddles attached to the shuttleless loom to hold the warp threads woven into the cloth;

wherein one or more warp threads are fed and held in a warp yarn direction fixed orientation.

27. The apparatus of claim 16 further comprising:

one or more heddles attached to the shuttleless loom to hold the warp threads woven into the cloth;

wherein one or more warp threads are fed and held in a warp yarn direction fixed orientation.

28. The apparatus of claim 20 further comprising:

one or more heddles attached to the loom to hold the warp threads woven into the cloth;

wherein one or more warp threads are fed and held in a warp yarn direction fixed orientation.

* * * * *